US005668443A

United States Patent [19]

Kawaguchi et al.

[11] Patent Number: 5,668,443

[45] Date of Patent: Sep. 16, 1997

[54] DISPLAY FLUORESCENT LAMP AND DISPLAY DEVICE

[75] Inventors: Hironobu Kawaguchi; Noriyuki Tomimatsu; Kazuo Yoshioka; Sadayuki Matsumoto, all of Tokyo, Japan

[73] Assignee: Mitsubishi Denki Kabushiki Kaisha, Tokyo, Japan

[21] Appl. No.: 545,274

[22] Filed: Oct. 19, 1995

Related U.S. Application Data

[63] Continuation-in-part of Ser. No. 381,420, Jan. 31, 1995.

[30] Foreign Application Priority Data

Jul. 21, 1994 [JP] Japan ..... 6-169718
Jun. 13, 1995 [JP] Japan ..... 7-146308

[51] Int. Cl.[6] ..... G09G 3/10

[52] U.S. Cl. ..... 315/169.1; 315/58; 313/594; 313/607; 313/573

[58] Field of Search ..... 315/169.1, 169.3, 315/200 A, 58; 313/594, 607, 573

[56] References Cited

U.S. PATENT DOCUMENTS 3,882,357 5/1975 Nieuweber et al. ..... 315/209 R
4,461,978 7/1984 Mikoshiba et al. ..... 315/169.4
4,645,979 2/1987 Chow .
4,887,002 12/1989 Dobashi et al. .

FOREIGN PATENT DOCUMENTS 61-8842 1/1986 Japan .
62-67584 3/1987 Japan .
4-280059 10/1992 Japan .
5-190152 7/1993 Japan .
457797 12/1936 United Kingdom .

*Primary Examiner*—Frank Gonzalez
*Assistant Examiner*—Reginald Ratliff
*Attorney, Agent, or Firm*—Burns, Doane, Swecker & Mathis, L.L.P.

[57] ABSTRACT

A display fluorescent lamp comprises; a dielectric cylindrical container having a large-diameter portion in which rare gas is sealed and a small-diameter portion which is almost coaxially connected with the large-diameter portion at one end of the large-diameter portion, the outside diameter thereof being smaller than that of the large-diameter portion; a light emitting portion which is formed at the other end of the large-diameter portion and has permeability; an internal electrode which is inserted into the cylindrical container from the other end of the small-diameter portion which is not connected with the large-diameter portion; a fluorescent substance layer formed on the inside face excluding that in which the light emitting portion is formed, of the large-diameter portion of the cylindrical container; and an external electrode formed on the outside face of the large-diameter portion excluding a portion in which the light emitting portion of the cylindrical container is formed, the length in the axial direction, of the small-diameter portion of the cylindrical container being set so as to be longer than an insulation distance required against a voltage to be applied between the internal electrode and the external electrode. Consequently, it is possible to ensure a sufficient insulation distance between the internal electrode and the external electrode even if the diameter of a glass valve is small.

20 Claims, 17 Drawing Sheets

FIG. 22B
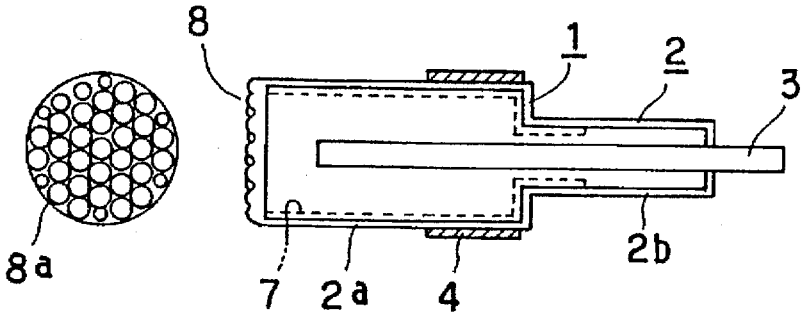
FIG. 22A
FIG. 23B
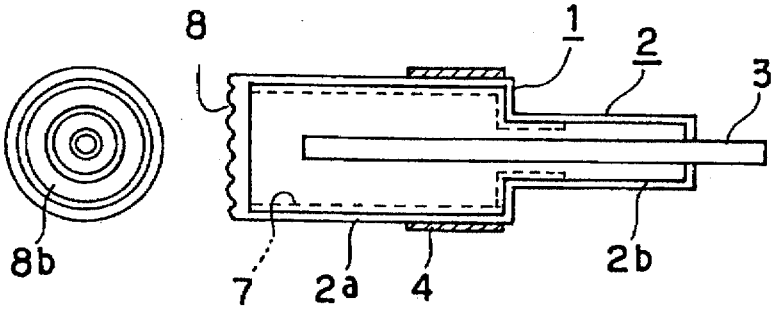
FIG. 23A
FIG. 24
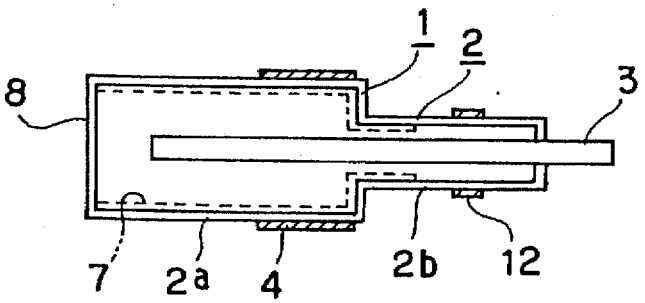

DISPLAY FLUORESCENT LAMP AND DISPLAY DEVICE

This application is a continuation-in-part of application Ser. No. 08/381,420, filed Jan. 31, 1995.

BACKGROUND OF THE INVENTION

1. Field of the Invention

The present invention relates to a display fluorescent lamp used as a light emitting device for use in, for example, a large image display unit or an electric sign board, and further relates to a display device.

2. Description of the Related Art

FIGS. 1 and 2 are a perspective view partially broken away of, and a sectional view of a conventional display fluorescent lamp disclosed in, for example, Japanese Patent Publication (Kokai) No. 5-190152. In the drawings, reference numeral 1 means a display fluorescent lamp, 2 is a cylindrical glass valve forming the display fluorescent lamp 1, and 3 is an internal electrode inserted into the glass valve 2 through a lower end surface of the glass valve 2. Further, reference numeral 4 means an external electrode mounted on an outer surface of the glass valve 2, 7 is a fluorescent substance layer formed on inner walls of a side surface and the lower end surface of the glass valve 2, and 8 is a light emitting portion having permeability mounted onto an upper end surface of the glass valve 2. A power source 6 is connected between the internal electrode 3 and the external electrode 4 via lead wires 5*a* and 5*b*.

A description will now be given of the operation. When the power source 6 applies ac voltage across the internal electrode 3 and the external electrode 4, the voltage is applied to a rare gas in the glass valve 2 through glass serving as dielectric material, thereby causing discharge. Ultraviolet rays are generated by the discharge to excite the fluorescent substance layer 7, and are thereafter converted into specific visible rays which are determined depending upon fluorescent substances.

Since a fluorescent substance itself has a white body, the visible rays emitted from the fluorescent substance are substantially totally reflected off the fluorescent substance layer 7 mounted on the inner wall of the glass valve 2, and are thereafter sent back into the glass valve 2. The visible rays can be outputted and emitted out of the glass valve 2 through the light emitting portion 8 exclusively having permeability. Thus, the display fluorescent lamp 1 serves as a light emitting device having high luminance.

The conventional display fluorescent lamp can serve as the light emitting device in a large image display unit to provide suitable emission with high luminance. However, with higher resolution of the large image display unit, it is necessary to reduce a diameter of the glass valve 2 for higher density arrangement of the display fluorescent lamps 1. Hence, a distance between the internal electrode 3 and the external electrode 4 is more reduced, resulting in problems in that, for example, a sufficient creepage distance can not be ensured for electrical insulation.

SUMMARY OF THE INVENTION

Accordingly, it is an object of the present invention to provide a display fluorescent lamp in which a sufficient insulation distance can be ensured between an internal electrode and an external electrode even if a glass valve has a smaller diameter.

It is another object of the present invention to provide a display fluorescent lamp in which the fluorescent substance layer can be formed uniformly.

It is still another object of the present invention to provide a display fluorescent lamp capable of suppressing power consumption.

It is a further object of the present invention to provide a display fluorescent lamp having high luminance.

It is a still further object of the present invention to provide a display fluorescent lamp in which the insulation distance between the internal electrode and the external electrode can be increased without enlarging the external shape of the display fluorescent lamp.

It is a still further object of the present invention to provide a display fluorescent lamp in which an external electrode can continuously be printed to have a constant thickness.

It is still further object of the present invention to provide a display fluorescent lamp in which a sufficient connecting space for connecting a lead wire to an external electrode can be provided within an extended cylindrical surface of a cylindrical container.

It is a still further object of the present invention to provide a display fluorescent lamp in which adjacent external electrodes can be prevented from being shortcircuitted.

It is a still further object of the present invention to provide a display fluorescent lamp in which an external electrode can be more easily printed onto a cylindrical container.

It is a still further object of the present invention to provide a display fluorescent lamp in which an external electrode can be formed by simply fitting a preformed cylindrical conductor material into a cylindrical container without complex process required in printing.

A still further object of the present invention is to provide a display fluorescent lamp in which luminance at a time when the lamp is not lighting due to reflection at a fluorescent substance layer can be reduced.

A still further object of the present invention is to provide a display fluorescent lamp in which constant transmittance can be provided in an entire range of visible rays.

Another object of the present invention is to provide a display fluorescent lamp in which luminance at a time when the lamp is not lighting can be reduced by utilizing a transmittance characteristic corresponding to a wavelength of visible rays.

Still another object of the present invention is to provide a display fluorescent lamp in which durability of a filter cap can be improved.

A further object of the present invention is to provide a display fluorescent lamp in which light emitting area can be enlarged.

A still further object of the present invention is to provide a display fluorescent lamp in which the cylindrical container can be formed easily.

A still further object of the present invention is to provide a display fluorescent lamp in which the light emitting portion is made of soda lime glass and the cylindrical portion is made of lead glass to facilitate fusion of the light emitting portion and the cylindrical portion.

A still further object of the present invention is to provide a display fluorescent lamp capable of reducing luminance at a time when the lamp is not lighting due to reflection on the fluorescent substance layer even when a flat shape light emitting portion is used.

A still further object of the present invention is to provide a display fluorescent lamp capable of reducing luminance at a time when the lamp is not lighting even if a flat shape light emitting portion is used, by providing constant transmittance in the entire range of visible rays.

A still further object of the present invention is to provide a display fluorescent lamp in which an luminance at a time when the lamp is not lighting can be reduced by utilizing a transmittance characteristic corresponding to the wavelength of visible rays even when a flat shape light emitting portion is used.

A still further object of the present invention is to provide a display fluorescent lamp in which luminance at a time when the lamp is not lighting can be reduced by suppressing reflection of external light on the flat shape light emitting portion with fine semispherical protrusions.

A still further object of the present invention is to provide a display fluorescent lamp in which luminance at a time when the lamp is not lighting can be reduced by suppressing reflection of external light on the flat shape light emitting portion with semicylindrical protrusions.

A still further object of the present invention is to provide a display fluorescent lamp in which stable discharge controlling is achieved.

A still further object of the present invention is to provide a display fluorescent lamp in which light emission of the fluorescent substance by discharge of a second external electrode is prevented.

A still further object of the present invention is to provide a display fluorescent lamp capable of suppressing power consumption by discharge of the second external electrode.

A still further object of the present invention is to provide a display device in which display fluorescent lamps can be arranged in high density for higher resolution of a display image.

A still further object of the present invention is to provide a display device in which color image display can be carried out by using luminescent colors including red, green, and blue.

A still further object of the present invention is to provide a display device in which the ratio of luminance of red, green and blue is controlled.

Another object of the present invention is to provide a display device in which control can be made to selectively turn ON each of a plurality of display fluorescent lamps by using few signal wires.

Still another object of the present invention is to provide a display device in which insulating tube coating can surely prevent short circuit between external electrodes of display fluorescent lamps adjacently disposed in parallel.

A further object of the present invention is to provide a display device which an insulating tube is reliably fixed to a display fluorescent lamp.

A still further object of the present invention is to provide a display device in which an insulating tube is mounted and fixed to a display fluorescent lamp by using heat shrinkage of the tube.

Another object of the present invention is to provide a display device in which insulating caps cover display fluorescent lamps adjacently disposed in parallel, thereby surely avoiding short circuit between mutual external electrodes and waterproofing the entire display fluorescent lamps.

Still another object of the present invention is to provide a display device in which luminance at a time when the lamp is not lighting due to reflection at a fluorescent substance layer can be reduced even when an insulating cap is used.

A further object of the present invention is to provide a display device in which constant transmittance can be provided in an entire range of visible rays even when an insulating cap is used.

A still further object of the present invention is to provide a display device in which luminance at a time when the lamp is not lighting can be reduced by using a transmittance characteristic corresponding to the wavelength of visible rays even when an insulating cap is used.

Another object of the present invention is to provide a display device in which durability of an insulating cap can be improved.

Still another object of the present invention is to provide a display device in which an insulating cap can surely and unremovably be secured to a display fluorescent lamp.

A further object of the present invention is to provide a display device in which an insulating cap can be easily fixed onto a cylindrical convex portion.

A still further object of the present invention is to provide a display device in which an insulating cap can be easily mounted to a cylindrical convex portion, and more tight engagement can be provided therebetween.

Another object of the present invention is to provide a display device in which luminance at a time when the lamp is not lighting due to reflection at a fluorescent substance layer can be reduced by avoiding entrance of external light such as sunlight.

According to the present invention, there is provided a display fluorescent lamp comprising; a dielectric cylindrical container having a large-diameter portion in which rare gas is sealed and a small-diameter portion which is almost coaxially connected with the large-diameter portion at one end of the large-diameter portion, the outside diameter thereof being smaller than that of the large-diameter portion; a light emitting portion which is formed at another end of the large-diameter portion and has permeability; an internal electrode which is inserted into the cylindrical container from the other end of the small-diameter portion which is not connected with the large-diameter portion; a fluorescent substance layer formed on the inside face excluding that in which the light emitting portion is formed, of the large-diameter portion of the cylindrical container; and an external electrode formed on the outside face of the large-diameter portion excluding a portion in which the light emitting portion of the cylindrical container is formed, the length in the axial direction of the small-diameter portion of the cylindrical container being set so as to be longer than an insulation distance required against a voltage to be applied between the internal electrode and the external electrode. The small-diameter portion of the display fluorescent lamp is capable of ensuring a sufficient insulation distance between the internal electrode and the external electrode even if the diameter of the cylindrical container is small, because the internal electrode is inserted into the cylindrical container from an end of the small-diameter portion thereof.

According to a preferred aspect of the present invention, a fluorescent substance layer is disposed to extend up to a joint between the small-diameter portion and the large-diameter portion of the cylindrical container. Consequently, the fluorescent substance layer disposed to extend up to the joint between the small-diameter portion and the large-diameter portion of the display fluorescent lamp makes it possible to form uniform fluorescent substance layer.

According to another preferred aspect of the present invention, an external electrode is formed so as to be shorter than the length of the large-diameter portion in the axial direction, of the cylindrical container. Consequently, it is possible to reduce power consumption.

According to still another preferred aspect of the present invention, an external electrode is formed in the vicinity of the lower end which is opposite the light emitting portion on the large-diameter portion of the cylindrical container. Consequently, it is possible to obtain high luminance.

According to a further preferred aspect of the present invention, folds are provided on the small-diameter portion in which the large-diameter portion is disposed, in order to enlarge the creepage distance. The folds improve dielectric strength without changing the size of the display fluorescent lamp.

According to a still further preferred aspect of the present invention, an external electrode is formed with conductive paste printed on the outside face of the cylindrical container. Consequently, it is possible to form the external electrode continuously with a uniform thickness on the outside face of the cylindrical container.

According to a yet still further preferred aspect of the present invention, an external electrode is formed so as to extend up to the outside face of the small-diameter portion of the cylindrical container. Consequently, it is possible to connect the lead wire with the external electrode and include the connecting portion within the extended cylindrical portion of the cylindrical container, thereby enabling the display fluorescent lamps to be disposed in high density.

According to a yet still further preferred aspect of the present invention, insulating film is formed on the outside face of portions other than the drive signal supplying portion of the external electrode. Consequently, when the plurality of the display fluorescent lamps are disposed adjacent to each other to form a display device, the insulation film formed on the external electrode of the display fluorescent lamp prevents short circuit between the respective external electrodes.

According to a yet still further preferred aspect of the present invention, a boundary portion between the large-diameter portion and the small-diameter portion of the cylindrical container is formed in a circular or slope shape. Forming the boundary portion between the large-diameter portion and the small-diameter portion of the cylindrical container in a circular or slope shape, not in a stepped shape facilitates printing process of the conductive paste for the external electrode, which is formed on the outside face of the cylindrical container.

According to a yet still further preferred aspect of the present invention, an external electrode is formed with a cylindrical conductive material and this external electrode is fit to the outside face of the cylindrical container. The cylindrical conductive material formed with a specified shape and dimensions by means of sheet metal working or the like is fit to the outside face of the cylindrical container. Consequently, the external electrode can be unified with the cylindrical container.

According to a yet still further preferred aspect of the present invention, a filter cap having wavelength selecting transmittance is provided on the outside face of the light emitting portion. The filter cap functions to reduce luminance at a time when the lamp is not lighting due to reflection on the fluorescent substance.

According to a yet still further preferred aspect of the present invention, a filter cap is formed so as to be a neutral density filter. The neutral density filter has a constant transmittance in the entire range of visible rays to reduce luminance at a time when the lamp is not lighting due to reflection on the fluorescent substance.

According to a yet still further aspect of the present invention, a filter cap is formed with a color filter. The color filter has a transmittance corresponding to the wavelength of visible rays generated by the fluorescent substance to reduce luminance at a time when the lamp is not lighting due to reflection on the fluorescent substance layer.

According to a yet still further aspect of the present invention, the filter cap is formed with silicone rubber. The filter cap made of silicone rubber improves the durability thereof.

According to a yet still further aspect of the present invention, a light emitting portion is formed in a flat shape. The flat shaped light emitting portion ensures a wide light emitting area.

According to a yet still further aspect of the present invention, the flat shaped light emitting portion is formed with a different material from the cylindrical portion of the cylindrical container and the cylindrical portion is formed of a dielectric having a higher softening point than that of the dielectric constituting the cylindrical portion. The dielectric having a higher softening point than that of the dielectric constituting the cylindrical portion facilitates forming of the cylindrical container.

According to a yet still further aspect of the present invention, a dielectric constituting the flat shaped light emitting portion is formed of soda-lime glass and the dielectric constituting the cylindrical portion is formed of lead glass. Consequently, it is possible to facilitate fusion between the light emitting portion and the cylindrical portion.

According to a yet still further aspect of the present invention, the dielectric constituting the flat shaped light emitting portion is formed so as to have a wavelength selecting transmittance. Consequently, it is possible to reduce luminance at a time when the lamp is not lighting due to reflection on the fluorescent substance layer.

According to a yet still further aspect of the present invention, the dielectric constituting the flat shaped light emitting portion is formed as a neutral density filter. The neutral density filter has a constant transmittance in the entire range of visible rays to reduce luminance at a time when the lamp is not lighting on the fluorescent substance layer.

According to a yet still further aspect of the present invention, the dielectric constituting the flat shaped light emitting portion is formed as a color filter. The color filter has a transmittance corresponding to the wavelength of visible rays to reduce luminance at a time when the lamp is not lighting due to reflection on the fluorescent substance.

According to a yet still further aspect of the present invention, the outside face of the flat shaped light emitting portion is provided with a plurality of fine semispherical protrusions. The plurality of fine semispherical protrusions reduces luminance at a time when the lamp is not lighting by hindering reflection of external light.

According to a yet still further aspect of the present invention, the outside face of the flat shaped light emitting portion is provided with a plurality of semicylindrical protrusions which are disposed coaxially. The semicylindrical protrusions disposed coaxially reduces luminance at a time when the lamp is not lighting by hindering reflection of external light on the light emitting portion.

According to a yet still further aspect of the present invention, the outside face of the small-diameter portion of the cylindrical container is provided with a second external electrode. The second external electrode stabilizes control of discharge.

According to a yet still further aspect of the present invention, a second external electrode is disposed at a position on the small-diameter portion of the cylindrical container, which does not overlap the fluorescent substance layer extended up to the joint with the large-diameter portion. Consequently, it is possible to suppress light emission of the fluorescent substance due to discharge by the second external electrode, thereby reducing luminance at a time when the lamp is not lighting.

According to a yet still further aspect of the present invention, a portion of the internal electrode corresponding to the second external electrode is coated with dielectric. Coating of dielectric reduces power consumption due to discharge by the second external electrode.

According to the present invention, there is provided a display device including a plurality of display fluorescent lamps each of which comprises; a dielectric cylindrical container having a large-diameter portion in which rare gas is sealed and a small-diameter portion which is almost coaxially connected with the large-diameter portion at one end of the large-diameter portion, the outside diameter thereof being smaller than that of the large-diameter portion; a light emitting portion which is formed at another end of the large-diameter portion and has permeability; an internal electrode which is inserted into the cylindrical container from the other end of the small-diameter portion which is not connected with the large-diameter portion; a fluorescent substance layer formed on the inside face excluding that in which the light emitting portion is formed, of the large-diameter portion of the cylindrical container; and an external electrode formed on the outside face of the large-diameter portion excluding a portion in which the light emitting portion of the cylindrical container is formed, the plurality of display fluorescent lamps being disposed adjacently in a linear or plane shape, the length of the small-diameter portion in the axial direction being set so as to be larger than the insulation distance required for a voltage to be applied between the internal electrode and the external electrode. The display fluorescent lamps having a small outside diameter, disposed in high density on a plane enables high resolution display of images.

According to a yet still further aspect of the present invention, three types of the display fluorescent lamps, red emission lamps, green emission lamps and blue emission lamps are disposed. These three color emission lamps disposed under a specified relation makes it possible to display color images with high resolution.

According to a yet still further aspect of the present invention, the external electrodes are formed so that the length thereof differs on the red emission lamp, the green emission lamp and the blue emission lamp. Consequently, it is possible to control the ratio of the brightness of the red emission lamps, the green emission lamps and the blue emission lamps.

According to a yet still further aspect of the present invention, the display fluorescent lamps are disposed in the form of matrix and the internal electrodes or the external electrodes of the display fluorescent lamps on each raw are connected with each other with respective coupling members. Consequently, it is possible to reduce the number of used signal lines.

According to a yet still further aspect of the present invention, a cylindrical convex portion is disposed for attaching a display fluorescent lamp at the portion facing to the display fluorescent lamp and the convex portion and portions excluding the light emitting portion of the display fluorescent lamp are covered with a common insulation tube. Consequently, it is possible to prevent short circuit between the external electrodes of the display fluorescent lamps.

According to a yet still further aspect of the present invention, adhesive layer is formed between the display fluorescent lamp and the insulation tube. The insulation tube is surely fixed to the display fluorescent lamp by means of adhesive existing therebetween.

According to a yet still further aspect of the present invention, an insulation tube is constructed in the form of a heat-shrinkable tube. By heating the heat-shrinkable tube put on the display fluorescent lamp and convex portion, the heat-shrinkable tube is secured firmly to the outside face of the display fluorescent lamp because of the shrinking force of the heat-shrinkable tube, thereby achieving insulation and protection between respective external electrodes.

According to a yet still further aspect of the present invention, the cylindrical convex portion on which the display fluorescent lamp is to be mounted is disposed on a portion facing to the display fluorescent lamp, and the convex portion and the light emitting portion of the display fluorescent lamp are covered with a common insulation cap. Consequently, it is possible to keep the respective display fluorescent lamps water-proof.

According to a yet still further aspect of the present invention, the insulation cap is formed with a wavelength selecting transmittance. Consequently, it is possible to avoid inconvenience of preparing the filter cap as a different part.

According to a yet still further aspect of the present invention, the insulation cap is formed as a neutral density filter. The neutral density filter has a constant transmittance in the entire range of visible rays to reduce luminance at a time when the lamp is not lighting.

According to a yet still further aspect of the present invention, the insulation cap is formed as a color filter. The color filter has a transmittance corresponding to the wavelength of visible rays to reduce luminance at a time when the lamp is not lighting due to reflection on the fluorescent substance layer.

According to a yet still further aspect of the present invention, the insulation cap is formed of silicone rubber. The silicone rubber made insulation cap improves the durability and weather resistance thereof.

According to a yet still further aspect of the present invention, adhesive layer is formed between the insulation cap and the display fluorescent lamp. By fixing the insulation cap to the display fluorescent lamp with adhesive, it is possible to prevent the insulation cap from loosening from the display fluorescent lamp.

According to a yet still further aspect of the present invention, protrusions are formed on the outside face of the cylindrical convex portion. The protrusions provided on the outside face of the cylindrical convex portion prevents the insulation caps from loosening from the convex portions, thereby stabilizing the mounting thereof.

According to a yet still further aspect of the present invention, the inside face of a portion covering the outside face of the cylindrical convex portion, of the insulation tube or the insulation cap is provided with protrusions and the outside face of the cylindrical convex portion corresponding to the protrusions is provided with concave portions engaging with the protrusions. Engagement of the protrusion provided on the insulation cap or the insulation tube with the concave portion provided on the cylindrical convex portion facilitates mutual engagement and stabilizes the engagement.

According to a yet still further aspect of the present invention, a light shielding portion is disposed to shield external light to the light emitting portion of the display fluorescent lamp. The light shielding mechanism prevents the external light such as sun light from directly entering the display fluorescent lamp and prevents luminance of the fluorescent lamp at a time when the lamp is not lighting due to reflection, thereby providing clear displayed images.

Further objects and advantage of the present invention will be made evident from the following description of the preferred embodiments thereof illustrated in the accompanying drawings.

BRIEF DESCRIPTION OF THE DRAWINGS

FIG. 22 is a sectional view showing still another embodiment of the display fluorescent lamp according to the present invention.

FIG. 23 is a sectional view showing still another embodiment of the display fluorescent lamp according to the present invention.

FIG. 24 is a sectional view showing still another embodiment of the display fluorescent lamp according to the present invention.

DETAILED DESCRIPTION OF THE PREFERRED EMBODIMENTS

Figure 1:
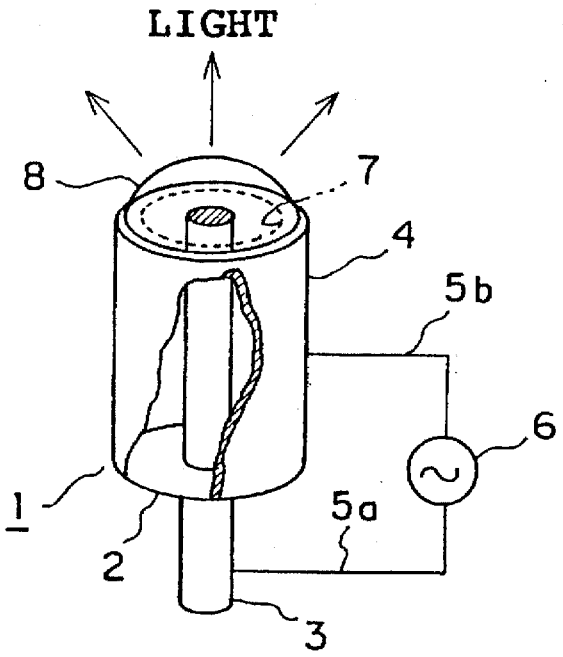
FIG. 1 (PRIOR ART)
FIG. 1 is a perspective view partially broken away of a conventional display fluorescent lamp.
Figure 2:
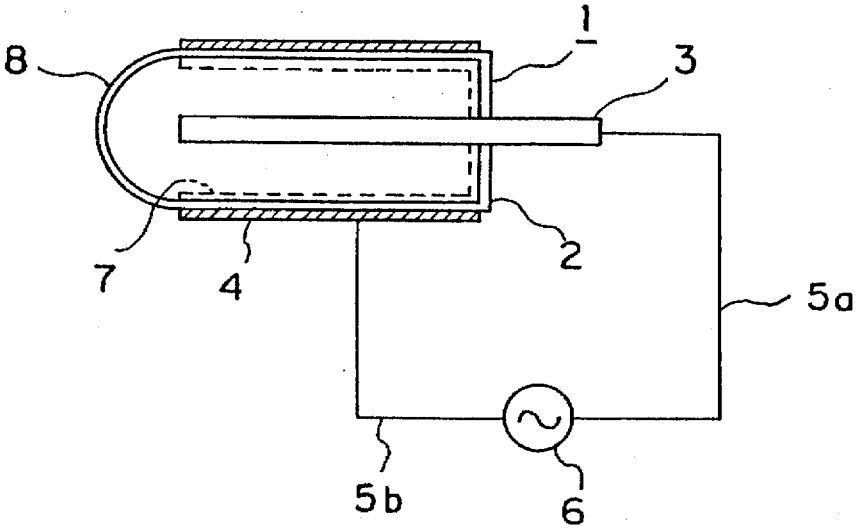
FIG. 2 (PRIOR ART)
FIG. 2 is a sectional view showing the conventional display fluorescent lamp.
Figure 3:
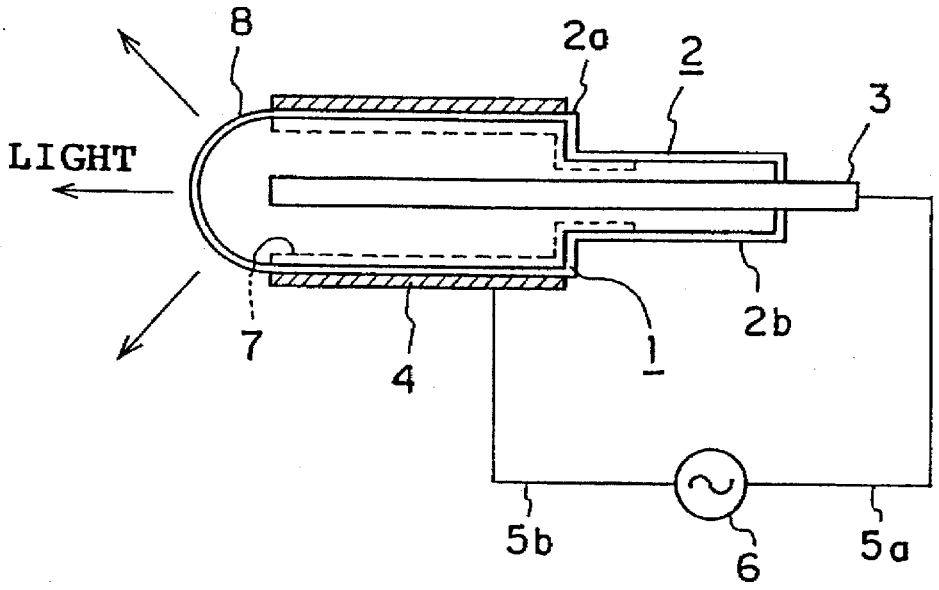
FIG. 3 is a sectional view showing one embodiment of a display fluorescent lamp according to the present invention.

FIG. 3 is a longitudinal sectional view of a display fluorescent lamp according to an embodiment of the present invention. In FIG. 3, reference numeral 1 means a display fluorescent lamp, and 2 is a cylindrical container forming the display fluorescent lamp 1, that is, a glass valve serving as a cylindrical container including portions having different diameters in an axial direction. Further, reference numeral 2a means a large diameter portion of the glass valve 2, and 2b is a small diameter portion of the glass valve 2.

Reference numeral 3 means an internal electrode inserted into the glass valve 2 through an end surface portion of the glass valve 2 on the side of the small diameter portion 2b, 4 is an external electrode mounted on an outer surface of the large diameter portion 2a of the glass valve 2, and 7 is a fluorescent substance layer formed on an internal side surface and an internal lower end surface of the large diameter portion 2a of the glass valve 2.

Reference numeral 8 means a light emitting portion having permeability, mounted at an upper end (i.e., at the left end in the drawing) of the large diameter portion 2a of the glass valve 2. The internal electrode 3 and the external electrode 4 are connected to a power source 6 via lead wires 5a and 5b.

A description will now be given of the operation. When voltage is applied by the power source 6 between the internal electrode 3 and the external electrode 4, the voltage is applied to rare gas in the display fluorescent lamp 1 through glass serving as dielectric material, resulting in discharge. Ultraviolet rays generated by the discharge excite the fluorescent substance layer 7, and are converted into specific visible rays determined depending upon fluorescent substances.

Since the fluorescent substance itself has a white body, the visible rays emitted from the fluorescent substance are substantially totally reflected off the fluorescent substance layer 7 which is formed on the inner surface of the glass valve 2 on the side of the large diameter portion 2a. Thereafter, the visible rays are sent back into the glass valve 2, and are finally outputted and emitted out of the glass valve 2 through the light emitting portion 8 having permeability.

The voltage applied between the internal electrode 3 and the external electrode 4 is in an approximate range of 200 to 2000 V while varying depending upon a type of the sealed rare gas or sealing pressure. For example, when the glass valve 2 has the large diameter portion 2a having diameter of 6.45 mm, and xenon is sealed as the rare gas at pressure of 200 Torr, it is necessary to apply voltage of about 600 V or more. In this case, an insulation distance of 5.6 mm or more is required as creepage distance in case application of, as an example, IEC380 standard is applied.

In the conventional display fluorescent lamp, it is impossible to extend the creepage distance between the internal electrode and the external electrode to be half the diameter of the glass valve or more. Therefore, the glass valve having diameter of 6.45 mm provides an insufficient creepage distance of about 3 mm.

On the other hand, in the display fluorescent lamp 1 of the present invention, when the glass valve 2 has the large diameter portion 2a having diameter of 6.45 mm and the small diameter portion 2b having diameter of 2.4 mm, it is possible to provide a creepage distance of about 6 mm or more by setting a length of the small diameter portion 2b to about 4 mm or more. Further, the applied voltage may exceed the above voltage depending upon the type of the sealed rare gas, the sealing pressure, and so forth. In such a case, it is also possible to provide a required creepage distance and sufficiently ensure electrical insulation between the internal electrode 3 and the external electrode 4 by appropriately setting the length of the small diameter portion 2b.

The external electrode 4 can efficiently and easily be formed by printing conductive paste on the outer surface of the glass valve 2 by using printing methods such as screen printing.

Figure 4:
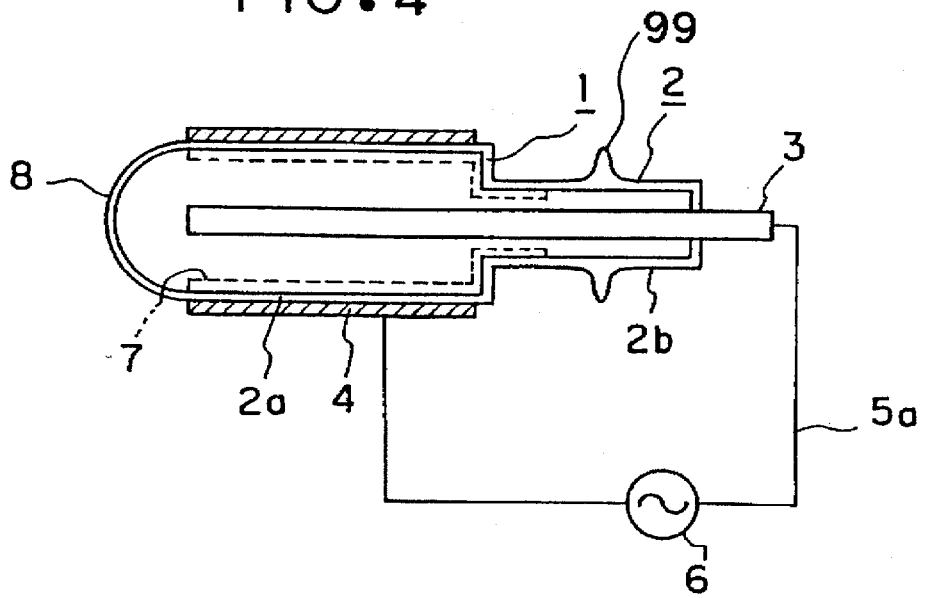
FIG. 4 is a sectional view showing another embodiment of the display fluorescent lamp according to the present invention.

FIG. 4 is a longitudinal sectional view showing another embodiment of the display fluorescent lamp according to the present invention. In the display fluorescent lamp 1 of this embodiment, the fluorescent substance layer 7 extends onto the small diameter portion 2b of the glass valve 2. In such a structure, highly accurate control on controlling the formation of the fluorescent substance layer 7 with a border portion between the large-diameter portion 2a and the small-diameter portion 2b is not required, so that a uniform fluorescent substance layer can be formed easily.

Reference numeral 99 designates "fold" or "wrinkle" provided on the external face of the small-diameter portion to extend the creepage distance. It is permissible to dispose a plurality of folds and further, as shown in FIG. 4, it is permissible to form the folds with different material from that of the small-diameter portion and attach them to the small-diameter portion.

Figure 5:
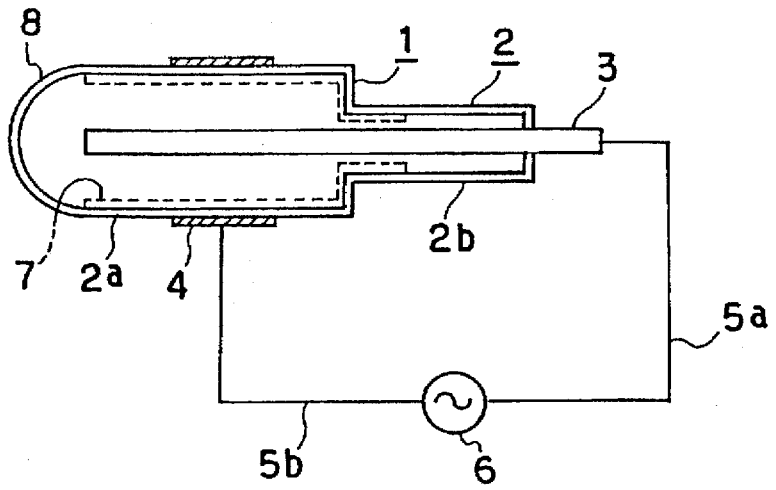
FIG. 5 is a sectional view showing still another embodiment of the display fluorescent lamp according to the present invention.
Figure 6:
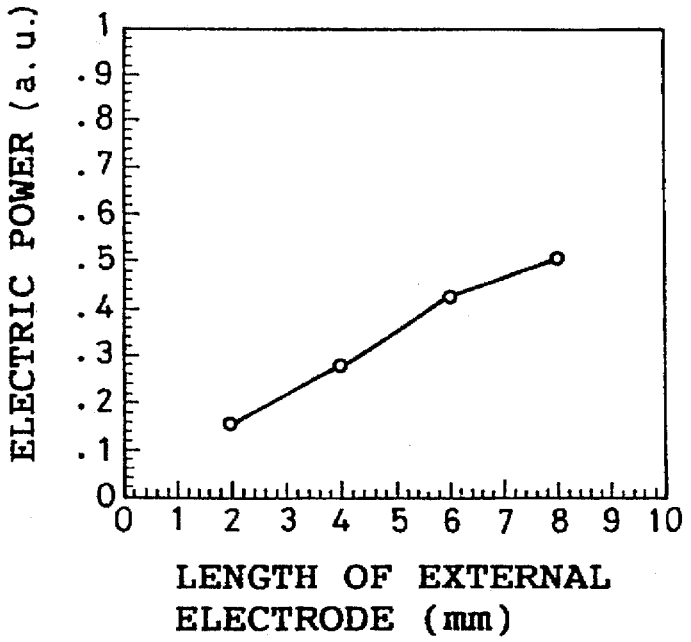
FIG. 6 is a graph showing a relationship between the length of the external electrode and power consumption.

FIG. 5 is a longitudinal sectional view showing still another embodiment of the display fluorescent lamp according to the present invention. In the display fluorescent lamp 1 of the embodiment, the external electrode 4 is shorter than the large-diameter portion 2a of the glass valve 2 in the axial direction. In measuring power consumed in the display fluorescent lamp 1 with the length of the external electrode 4 set as a parameter, power consumption increases with the length of the external electrode 4. FIG. 6 shows an example of this phenomenon. Thus, if the length of the external electrode 4 is determined to be the same as the length of the large-diameter of the glass valve 2 in the axial direction as in the conventional example, excessive power is consumed. On the contrary, if the length of the external electrode 4 is determined to be shorter than the length of the large-diameter portion 2a of the glass valve 2 in the axial direction, it is possible to keep the power consumption of the display fluorescent lamp 1 on an appropriate value.

Figure 7:
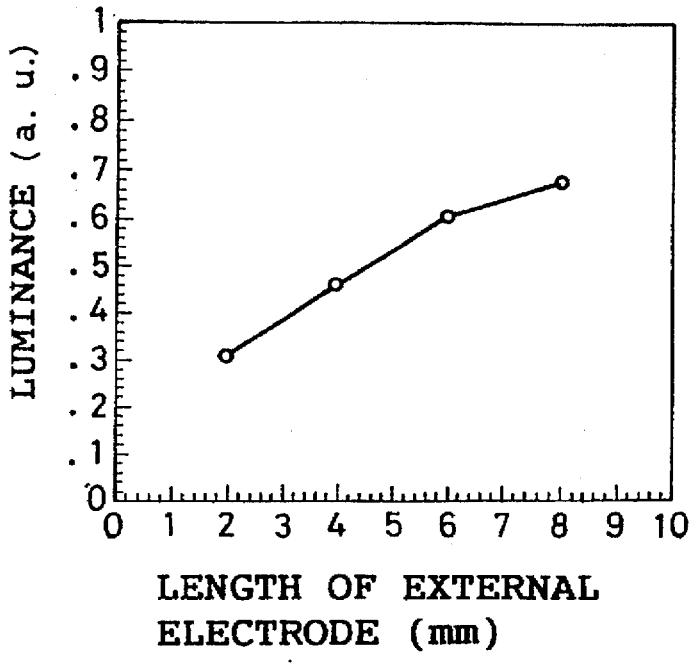
FIG. 7 is a graph showing a relationship between the length of the external electrode and emission luminance.

FIG. 7 shows the result of measurement of the emission luminance of the display fluorescent lamp 1 with the length of the external electrode 4 set as a parameter. As shown in FIG. 7, it is made evident that the emission luminance of the display fluorescent lamp 1 increases with the length of the external electrode 4. On the other hand, when a color display device is constructed by combining a red emission lamp, a green emission lamp and a blue emission lamp, appropriate luminance ratio is needed in the emission luminance of the red emission lamp, the green emission lamp and the blue emission lamp with respect to a problem about the reproduction of colors. As a means for realizing this, it can be considered to differentiate the values of voltages to be applied between the internal electrode 3 and the external electrode 4 with respect to the red emission lamp, the green emission lamp and the blue emission lamp. For this purpose, it is necessary to prepare a plurality of types of power supplies. If the lengths of the external electrodes 4 of the display fluorescent lamps 1 used as the red emission lamp, the green emission lamp and the blue emission lamp are made different using the characteristic shown in FIG. 7, the emission luminance of the display fluorescent lamp 1 used as the red emission lamp, the green emission lamp and the blue emission lamp can be adjusted easily, thereby realizing a required luminance ratio easily.

Figure 8:
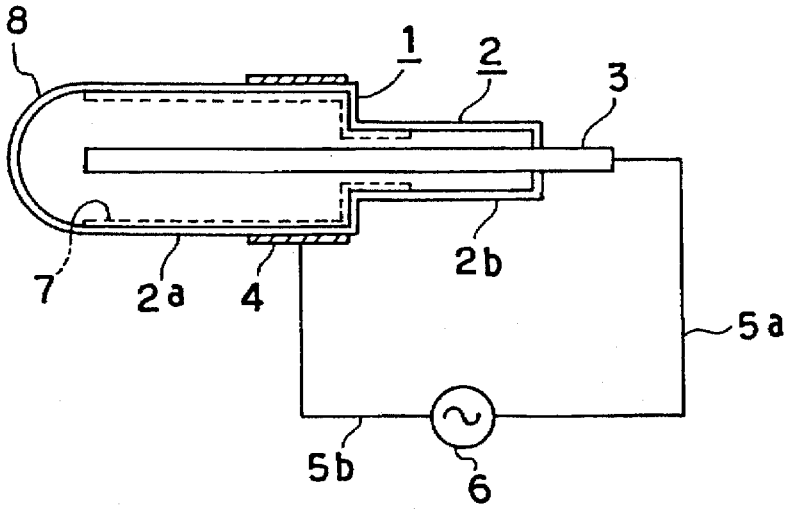
FIG. 8 is a sectional view showing still another embodiment of the display fluorescent lamp according to the present invention.
Figure 9:
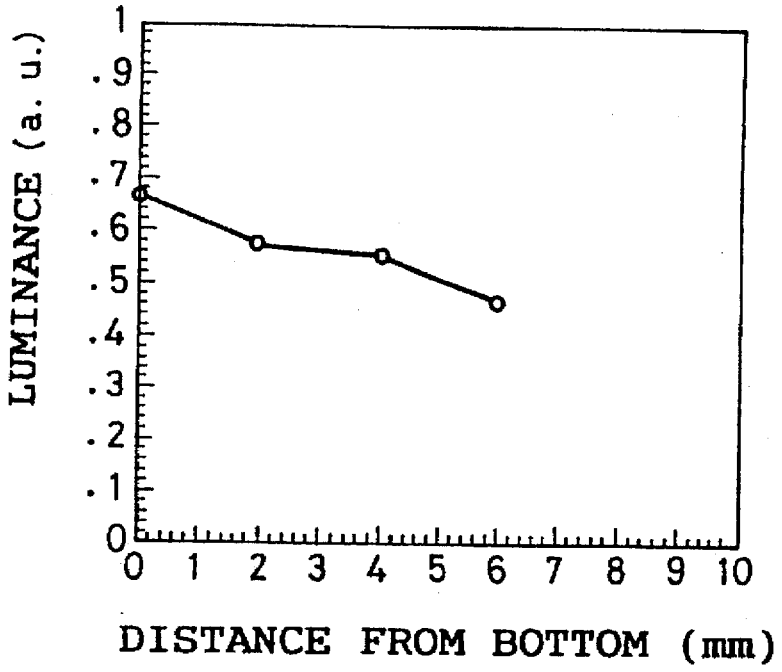
FIG. 9 is a graph showing a relationship between the position of the external electrode and emission luminance.

FIG. 8 is a longitudinal sectional view of the display fluorescent lamp according to still another embodiment of the present invention. In the display fluorescent lamp according to this embodiment, the external electrode 4 which is shorter than the length in the axial direction of the large-diameter portion 2a of the glass valve 2 is formed in the vicinity of the lower end of the large-diameter portion 2a of the glass valve 2. If the length of the external electrode 4 is set to be shorter than the length in the axial direction of the large-diameter portion 2*a* of the glass valve 2, it becomes to be a problem where the external electrode 4 is disposed in the large-diameter portion 2*a* of the glass valve 2. Thus, with the external electrode 4 forming position as a parameter, the emission luminance of the display fluorescent lamp 1 is measured. As a result, the result shown in FIG. 9 is obtained. Namely, it is testified that the emission luminance of the display fluorescent lamp 1 can be kept high by forming the external electrode 4 in the vicinity of the lower end of the large-diameter 2*a* of the glass valve 2. This can be considered to be because light emission of the fluorescent substance layer formed on the lower end contributes largely to the emission luminance of the display fluorescent lamp 1. Thus, it is possible to obtain a display fluorescent lamp having high luminance by forming the external electrode 4 in the vicinity of the lower end of the large-diameter portion 2*a* of the glass valve 2.

Figure 10:
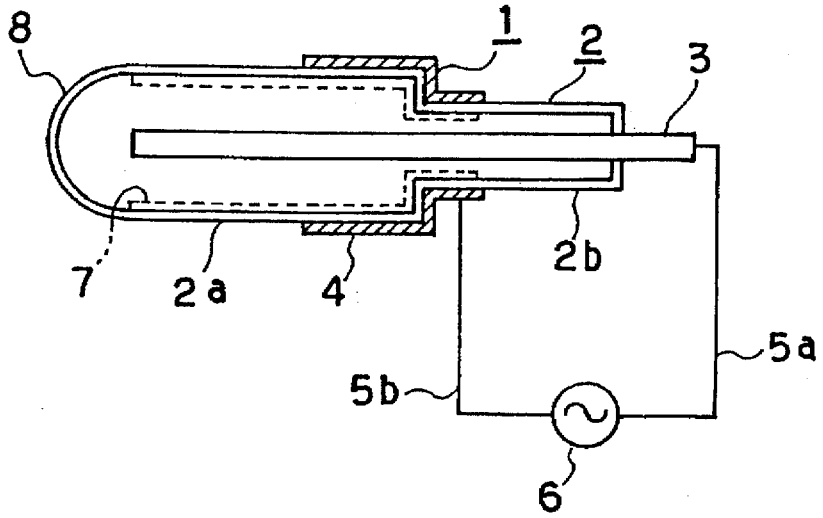
FIG. 10 is a sectional view showing still another embodiment of the display fluorescent lamp according to the present invention.

FIG. 10 is a longitudinal sectional view of the display fluorescent lamp according to still another embodiment of the present invention. In the display fluorescent lamp of this embodiment, the external electrode 4 extends to the small-diameter portion 2*b* of the glass valve 2. In this construction, It is possible to provide a sufficient space required to connect the lead wire 5*b* with the external electrode 4 within an extended cylindrical surface of the large diameter portion 2*a* of the glass valve 2. Consequently, the connecting portion for the lead wire 5*b* does not require an unnecessarily large outside diameter, resulting in high density arrangement of the display fluorescent lamps 1.

Figure 11:
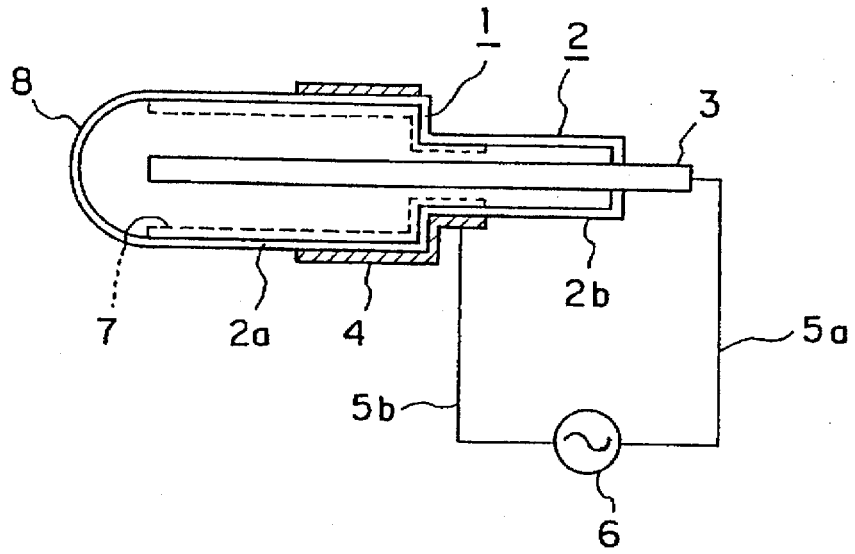
FIG. 11 is a sectional view showing still another embodiment of the display fluorescent lamp according to the present invention.

FIG. 11 is a longitudinal sectional view of the display fluorescent lamp according to still another embodiment of the present invention. In the display fluorescent lamp of this embodiment, the external electrode 4 extends to a part of the small-diameter portion 2*b* of the glass valve 2. In this case also, as in the above embodiment shown in FIG. 10, the connecting portion for the lead wire 5*b* does not require an unnecessarily large outside diameter, resulting in high density arrangement of the display fluorescent lamps 1.

Figure 12:
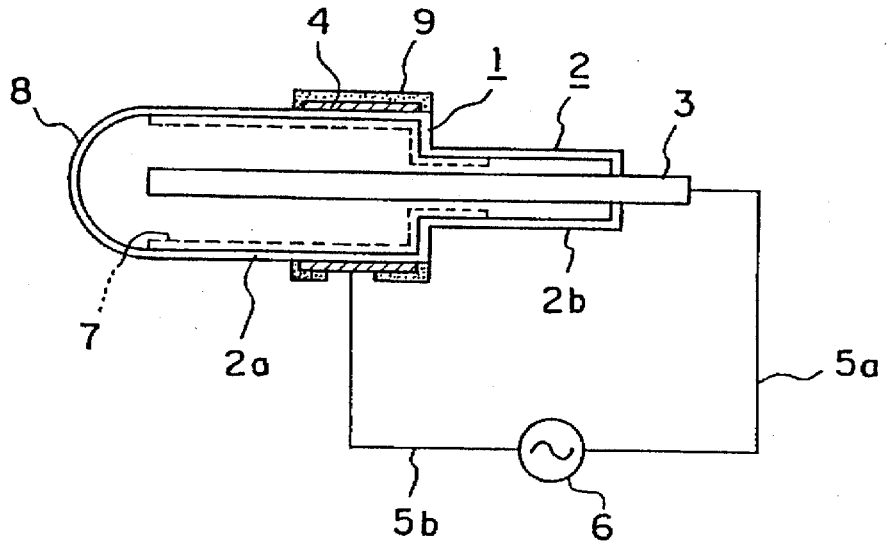
FIG. 12 is a sectional view showing still another embodiment of the display fluorescent lamp according to the present invention.

FIG. 12 is a longitudinal sectional view of the display fluorescent lamp according to still another embodiment of the present invention. In the display fluorescent lamp of this embodiment, insulating film 9 is coated on portions other than the drive signal supplying portion of the external electrode 4. According to this embodiment, when a plurality of the display fluorescent lamps 1 are disposed to form a display device, it is possible to prevent short circuit between adjacent external electrodes 4.

Figure 13:
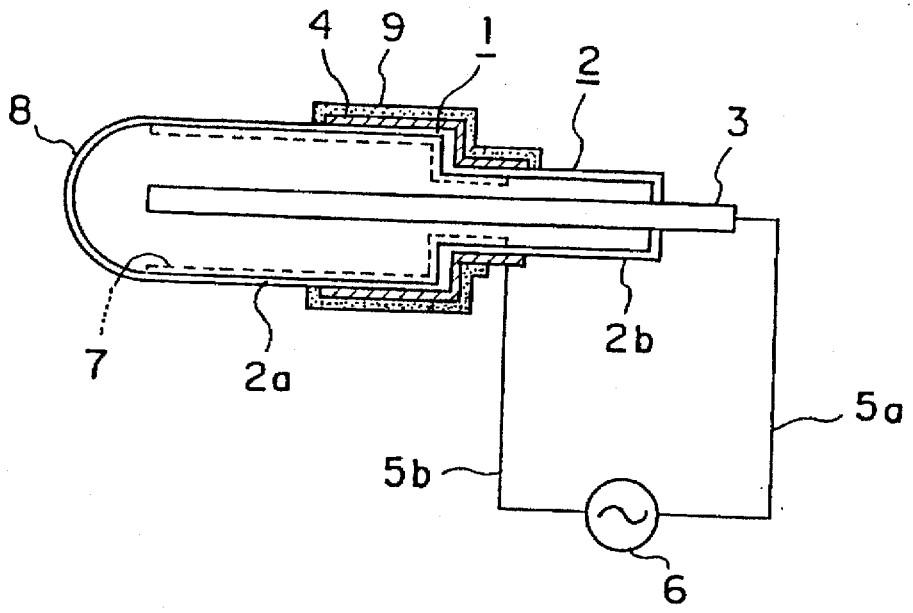
FIG. 13 is a sectional view showing still another embodiment of the display fluorescent lamp according to the present invention.

FIG. 13 is a longitudinal sectional view of the display fluorescent lamp according to still another embodiment of the present invention. In the display fluorescent lamp of this embodiment, the external electrode 4 extends to a part of the small-diameter portion 2*b* of the glass valve 2 and the insulating film 9 is coated on portions other than the drive signal supplying portion of the external electrode 4. As in the above embodiment, this embodiment enables the display fluorescent lamps to be disposed in high density and prevents short circuit between the external electrodes 4 of the adjacent display fluorescent lamps 1.

Figure 14:
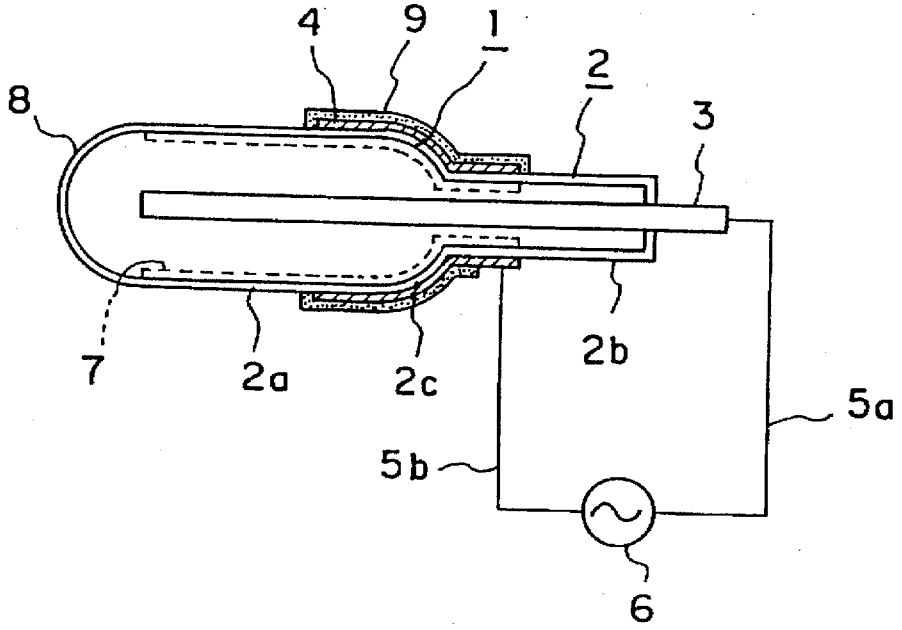
FIG. 14 is a sectional view showing still another embodiment of the display fluorescent lamp according to the present invention.

FIG. 14 is a longitudinal sectional view of the display fluorescent lamp according to still another embodiment of the present invention. In the display fluorescent lamp of this embodiment, the boundary portion of the large-diameter portion 2*a* and the small-diameter portion 2*b* of the glass valve 2 is formed in a circular shape. According to this embodiment, when the external electrode 4 is formed to extend from the large-diameter portion 2*a* to the small-diameter portion 2*b* of the glass valve 2 by printing conductive paste thereon, the printing can be performed continuously and easily through the circular portion 2*c* and further, the insulating film 9 can be formed easily.

Figure 15:
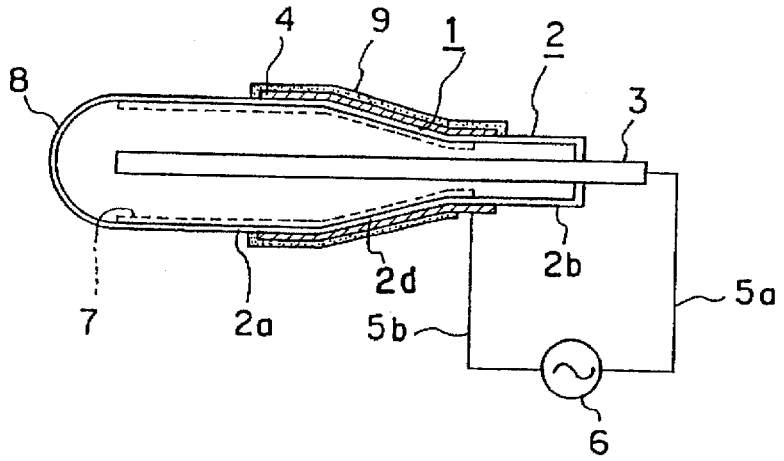
FIG. 15 is a sectional view showing still another embodiment of the display fluorescent lamp according to the present invention.

FIG. 15 is a longitudinal sectional view of the display fluorescent lamp according to still another embodiment of the present invention. In the display fluorescent lamp of this embodiment, a portion (boundary portion) adjacent to the large-diameter portion 2*a* and the small-diameter portion 2*b* of the glass valve 2 is formed in a slope shape. In this embodiment also, it is possible to form conductive paste or insulating film 9 for the external electrode 4 on the large-diameter portion 2*a* and the small-diameter portion 2*b*, continuously and easily via the slope shaped portion 2*d*.

Figure 16:
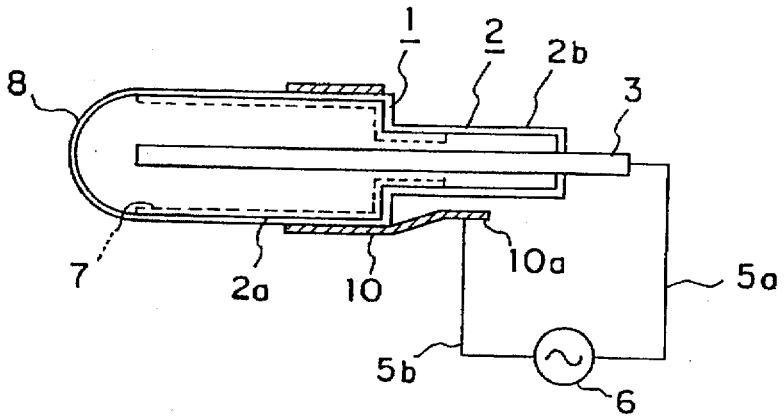
FIG. 16 is a sectional view showing still another embodiment of the display fluorescent lamp according to the present invention.
Figure 17:
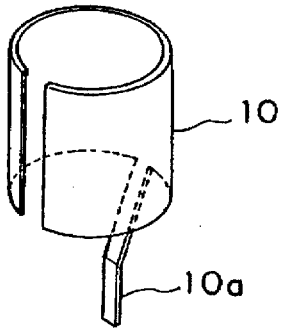
FIG. 17 is a perspective view showing a cylindrical conductor material in FIG. 10.

FIG. 16 is a longitudinal sectional view of the display fluorescent lamp according to still another embodiment of the present invention. In the display fluorescent lamp of this embodiment, the external electrode 4 is formed with a cylindrical conductive material 10 as shown in FIG. 17 and fit to the external face of the large-diameter portion 2*a* of the glass valve 2. In this embodiment, the cylindrical conductive material 10 is cut out of a plate and formed by pressing or the like and connecting strip 10*a* with the lead wire 5*b* is bent toward the center thereof.

Therefore, according to this embodiment, it is possible to omit such processes as printing, drying and calcining necessary for forming conductive paste by printing, thereby improving the efficiency of assembly.

Figure 18:
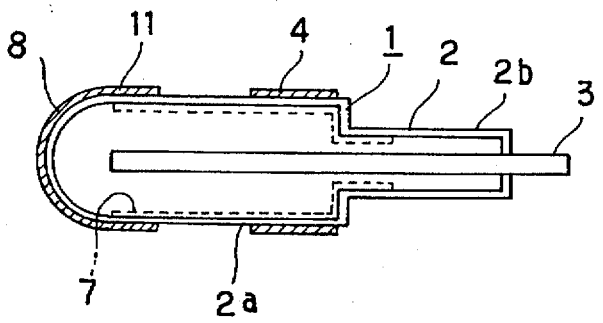
FIG. 18 is a sectional view showing still another embodiment of the display fluorescent lamp according to the present invention.

FIG. 18 is a longitudinal sectional view of the display fluorescent lamp according to still another embodiment of the present invention. In the display fluorescent lamp of this embodiment, a filter cap 11 having waveform selecting transmittance is provided on the light emitting portion 8 of the glass valve 2. External light which enters the glass valve 2 through the light emitting portion 8 is reflected by the fluorescent substance layer 7 and a part of the reflected light goes out through the light emitting portion 8, thereby raising luminance. This embodiment prevents such luminance at a time when the lamp is not lighting by damping it by filtering twice when external light enters and the reflected light goes out, thereby consequently intensifying contrast of displayed images.

Meanwhile, the filter cap 11 having the aforementioned waveform selecting transmittance may be constructed with a neutral density filter having a constant transmittance in the entire range of visible rays. In this case, it is possible to reduce luminance at a time when the lamp is not lighting due to reflection by the fluorescent substance effectively because a specified transmittance is obtained in the entire range of visible rays. Further, it is permissible to construct the filter cap 11 with a color filter having a transmittance characteristic corresponding to the wavelength of visible rays generated by the fluorescent substance. In this case, the contrast can be improved. Still further, it is permissible to construct the filter cap 11 with silicone rubber, thereby improving weather proof.

Figure 19:
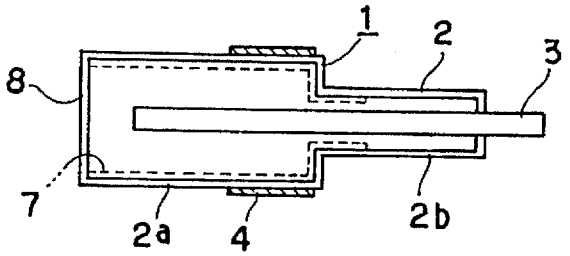
FIG. 19 is a sectional view showing still another embodiment of the display fluorescent lamp according to the present invention.
Figure 20:
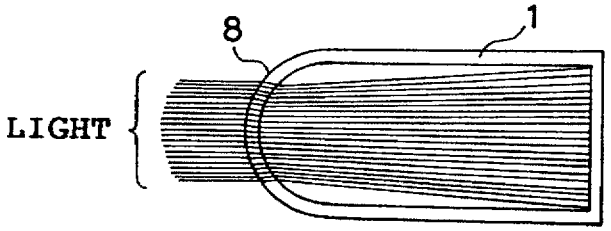
FIG. 20 is a view showing light emission in a case in which the light emitting portion is semispherical.
Figure 21:
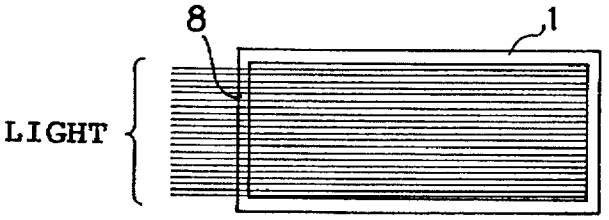
FIG. 21 is a view showing light emission in a case in which the light emitting portion is flat.

FIG. 19 is a longitudinal sectional view of the display fluorescent lamp according to still another embodiment of the present invention. In the display fluorescent lamp of this embodiment, the light emitting portion 8 of the glass valve 2 is formed in a flat shape. If the light emitting portion 8 is semispherical, light generated from the fluorescent substance layer formed at the lower end of the large-diameter portion 2*a* of the glass valve 2, which contributes largely to the emission luminance of the display fluorescent lamp 1 is introduced to the front side of the display fluorescent lamp 1 by the light emitting portion 8 through an area smaller than the internal diameter area of the large-diameter portion 2*a* of the glass valve 2, as shown in FIG. 20, because of the effect of a concave lens. On the other hand, when the light emitting portion 8 is in a plan shape, as shown in FIG. 21, light generated from the fluorescent substance layer formed on the lower end of the large-diameter portion 2*a* of the glass valve 2 can be introduced to the front side of the display fluorescent lamp 1 through its generating area or the internal diameter area of the large-diameter portion 2*a* of the glass valve 2. Therefore, by forming the light emitting portion 8 in a plan shape, it is possible to enlarge light emitting area viewed from the front side of the display fluorescent lamp 1. In FIGS. 20 and 21, influences of the small-diameter portion 2*b* is neglected from the viewpoint of convenience of simulation.

Further, by forming the flat shaped light emitting portion 8 with a material different from that of the large-diameter portion 2*a* of the glass valve 2 so as to have a higher softening point than that of glass used for the large-diameter portion 2*a* of the glass valve 2, it is possible to form the glass valve 2 easily.

As an example, by forming the light emitting portion 8 with soda-lime glass and the large-diameter portion 2*a* of the glass valve 2 with lead glass, it is possible to facilitate fusion of the light emitting portion 8 and the large-diameter portion 2*a* of the glass valve 2.

When external light enters the glass valve 2 through the light emitting portion 8, it is reflected by the fluorescent substance layer 7 and then goes out through the light emitting portion 8, thereby increasing the luminance. By forming the light emitting portion 8 of the glass valve 2 with glass having wavelength selecting transmittance to reduce such luminance at a time when the lamp is not lighting by damping by filtering twice when light enters and goes out, high contrast displayed images can be obtained.

The aforementioned light emitting portion 8 having wavelength selecting transmittance may be constructed with a neutral density filter having a constant transmittance in the entire range of visible rays. In this case, by obtaining a constant transmittance characteristic in the entire range of visible rays, it is possible to reduce luminance at a time when the lamp is not lighting caused by reflection by the fluorescent substance. Further, it is permissible to construct the light emitting portion 8 with a color filter having a transmittance characteristic corresponding to the wavelength of visible rays generated by the fluorescent substance, thereby improving contrast.

FIG. 22 is a longitudinal sectional view of the display fluorescent lamp according to still another embodiment of the present invention. In the display fluorescent lamp of this embodiment, a plurality of small sized semispherical protrusions 8*a* are provided on the external face of the light emitting portion 8. According to this embodiment, by scattering external light which enters the light emitting portion 8 by means of small sized semispherical protrusions 8*a*, it is possible to prevent the external light from entering through the flat shaped light emitting portion 8.

FIG. 23 is a longitudinal sectional view of the display fluorescent lamp according to still another embodiment of the present invention. In the display fluorescent lamp of this embodiment, a plurality of semicylindrical protrusions 8*b* are provided on the external face of the light emitting portion 8. In this case also, it is possible to prevent external light from entering through the flat shaped light emitting portion 8.

FIG. 24 is a longitudinal sectional view of the display fluorescent lamp according to still another embodiment of the present invention. In the display fluorescent lamp of this embodiment, a second external electrode 12 is disposed on the external face of the small-diameter portion 2*b* of the glass valve 2. In this case, by space charge generated by discharge (auxiliary discharge) caused by applying voltage between the internal electrode 3 and the second external electrode 12, it is possible to generate discharge (main discharge) between the internal electrode 3 and the external electrode 4 easily.

Generally, a voltage necessary for starting discharge is a function of the product pd of gas pressure p of space discharge and the gap length d of the discharge space according to Paschen's law, and it is well known that the minimum value is reached when the pd is a particular value. Ordinarily, in the discharge lamp, the product pd is set so as to exceed the product pd which gives this minimum value. When gas pressure is specified, the longer the gap length, the higher voltage necessary for starting discharge becomes.

Thus, the discharge between the internal electrode 3 and the external electrode 4 needs a higher voltage for starting discharge as compared to discharge between the internal electrode 3 and the second external electrode 12. Thus, even if a voltage for generating discharge is applied between the internal electrode 3 and the second external electrode 12, no discharge occurs between the internal electrode 3 and the external electrode 4. On the other hand, when a particular voltage necessary for starting discharge between the internal electrode 3 and the external electrode 4 is applied between the internal electrode 3 and the external electrode 4, it is possible to start stabilized discharge with a voltage lower than when no space charge exists, by space charge generated by auxiliary discharge.

As for a position in which the second external electrode 12 is mounted, by mounting the second external electrode 12 at a position which is located on the small-diameter portion 2*b* of the glass valve 2 so as not to overlap the fluorescent substance layer, it is possible to prevent light emission of the display fluorescent lamp 1 due to discharge between the internal electrode 3 and the second external electrode 12.

Figure 25:
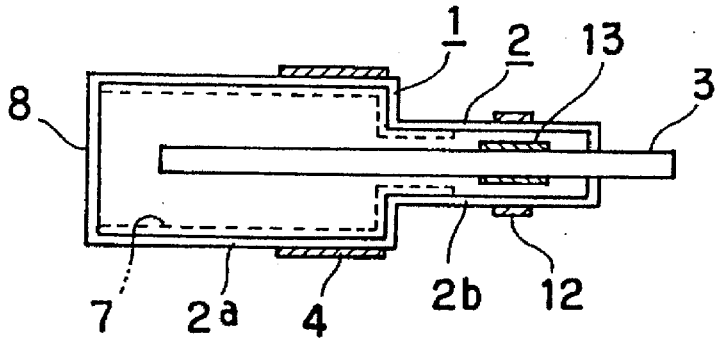
FIG. 25 is a sectional view showing still another embodiment of the display fluorescent lamp according to the present invention.
Figure 26:
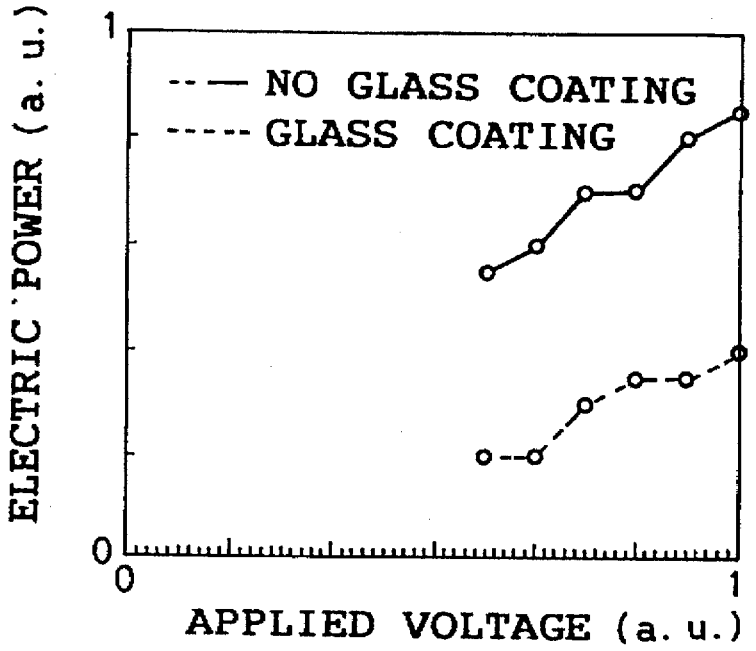
FIG. 26 is a diagram showing effects of a case in which a portion of the internal electrode corresponding to the external electrode is coated with glass.

FIG. 25 is a longitudinal sectional view of the display fluorescent lamp according to still another embodiment of the present invention. In the display fluorescent lamp of this embodiment, glass coating 13 is formed on a portion of the internal electrode 3, which corresponds to the second external electrode 12. In this case, it is possible to reduce power consumption by the auxiliary discharge as shown in FIG. 26.

Figure 27:
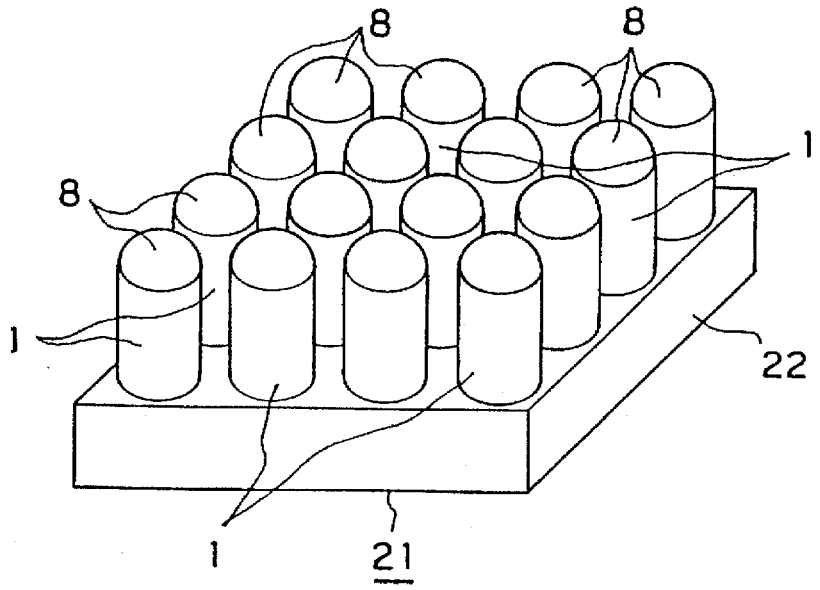
FIG. 27 is a perspective view of a display device according to still another embodiment of the present invention.

FIG. 27 is a perspective view of the display device according to an embodiment of the present invention. In the display device of this embodiment, a plurality of the display fluorescent lamps 1 as shown in FIGS. 3–25 are disposed on a base member 22 in the form of a plane.

According to this embodiment, because the small-diameter portion 2*b* is provided on the glass valve 2 to extend the insulation distance, the outside diameter of the large-diameter portion 2*a* can be reduced to a possible extent. Consequently, it is possible to construct a display device in which a high resolution large-scale image display unit is formed.

Figure 28:
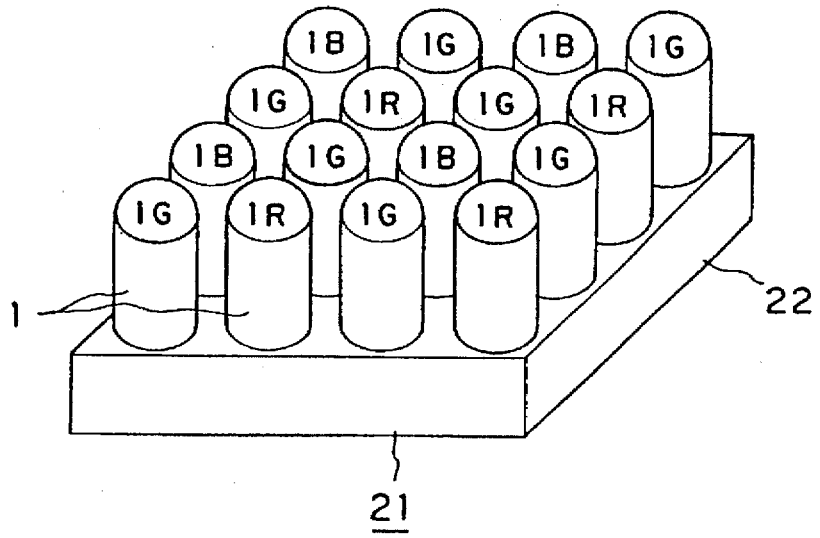
FIG. 28 is a perspective view of a display device according to still another embodiment of the present invention.

FIG. 28 is a perspective view of the display device according to another embodiment of the present invention. In the display device of this embodiment, the display fluorescent lamps 1 are divided to red emission lamp 1R, green emission lamp 1G and blue emission lamp 1B, and a plurality of the display fluorescent lamps are arranged on the base member 22 in a specified order. According to this embodiment, by turning ON respective emission lamps 1R, 1G, 1B in various ratios, various emission colors can be reproduced and thus, it is possible to construct a high resolution color image display unit.

Figure 29:
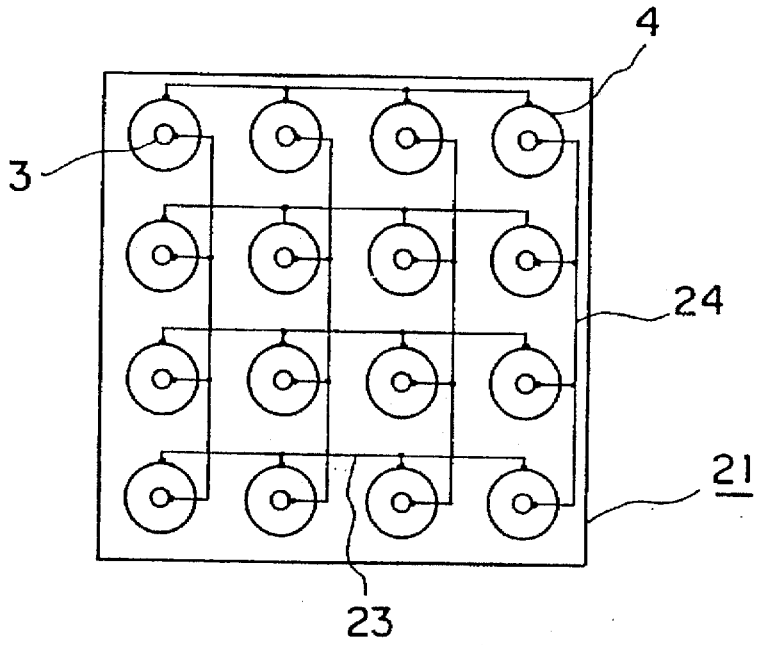
FIG. 29 is a schematic diagram showing a display device according to still another embodiment of the present invention.

FIG. 29 is a plan view showing electric connection in still another embodiment of the display device according to the present invention. In the display device of this embodiment, display lamps 1 are arranged in a matrix form, with external electrodes 4 of the display fluorescent lamps 1 mutually connected for each row, and internal electrodes 3 of the display fluorescent lamps 1 mutually connected for each column. There are provided connecting members 24 for interconnecting the external electrodes 4, and connecting members 24 for interconnecting the internal electrodes 3. This structure can realize an interface between the display device 21 and an external display device drive circuit (not shown) by only eight signal lines (i.e., four connecting members 23 and four connecting members 24).

FIG. 29 shows the display device 21 formed by interconnecting the external electrodes 4 of the display fluorescent lamps 1 for each row, and by interconnecting the internal electrodes 3 of the display fluorescent lamps 1 for each column. However, for the purpose of the same effect, the display device 21 may be formed by connecting the mutual internal electrodes 3 of the display fluorescent lamps 1 for each row, and by connecting the mutual external electrodes 4 of the display fluorescent lamps 1 for each column.

Figure 30:
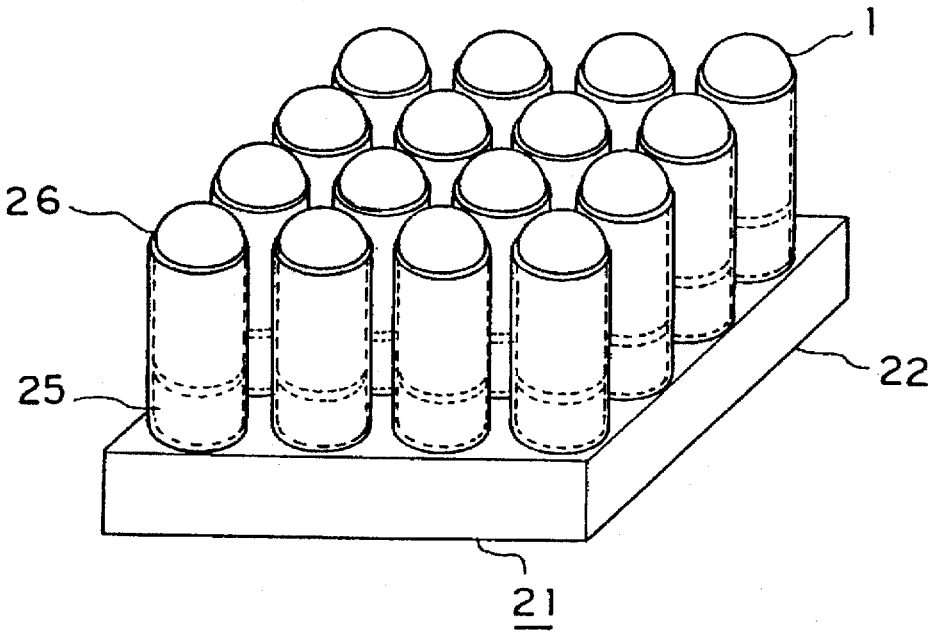
FIG. 30 is a perspective view showing a display device according to still another embodiment of the present invention.
Figure 31:
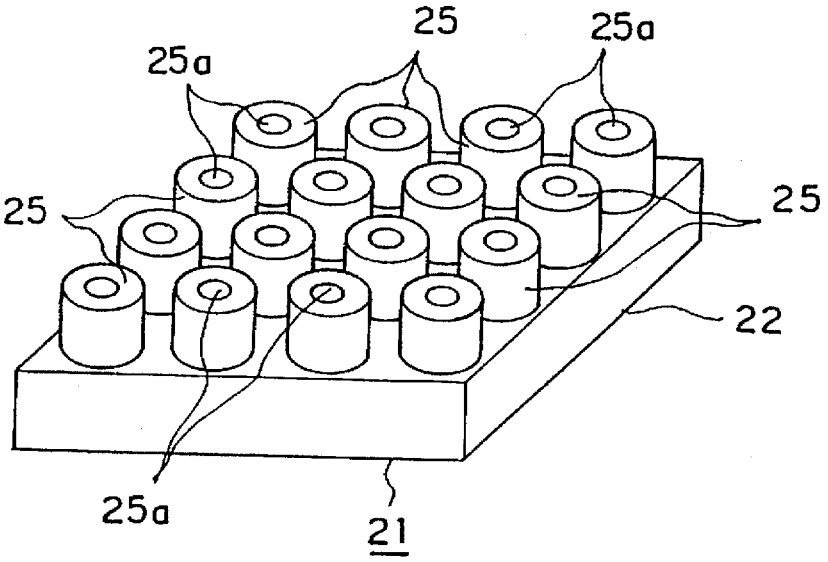
FIG. 31 is a perspective view showing the base member provided with the cylindrical convex portions shown in FIG. 30.
Figure 32:
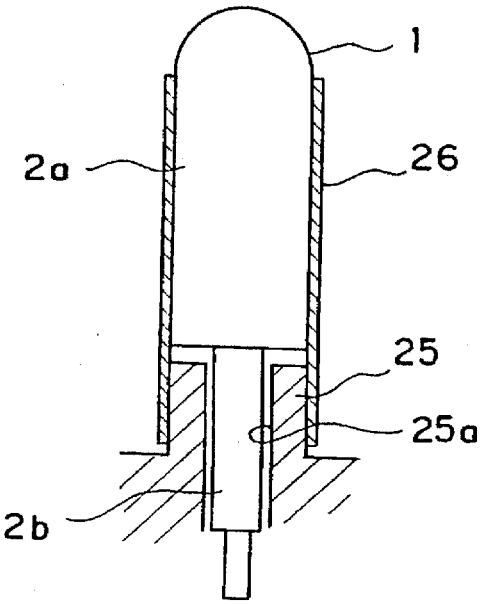
FIG. 32 is a sectional view showing the display fluorescent lamp shown in FIG. 30.

FIG. 30 is a perspective view of the display device according to still another embodiment of the present invention. According to this embodiment, convex portions 25 on which the display fluorescent lamps 1 are to be mounted as shown in FIG. 31 are disposed on positions on the base member 22 of the display device 21, corresponding to the display fluorescent lamp 1. The convex portion 25 and portions other than the light emitting portion 8 of the display fluorescent lamp 1 are sealed by a common insulation tube 26 as shown in FIG. 32 to form the display device 21.

According to this embodiment, the small-diameter portion **2*b* of the glass valve 2 is inserted into the center hole 25*a* of the convex portion 25 and the large-diameter portion 25 thereof is made to face the top face of the convex portion 25. Then, the insulation tube 26 covers the display fluorescent lamp 1 and the convex portion 25, thereby securing prevention of short circuit between the adjacent external electrodes 4 of the display fluorescent lamp 1. Meanwhile, the external electrodes 4** are omitted here for convenience.

Figure 33:
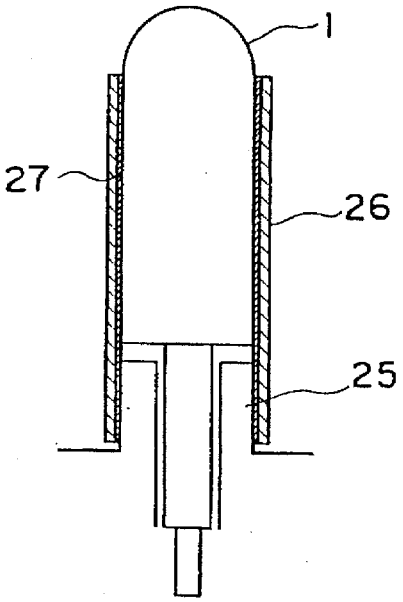
FIG. 33 is a sectional view showing the display device according to still another embodiment of the present invention.

FIG. 33 is a sectional view of the major part of the display device according to still another embodiment of the present invention. In the display device of this embodiment, adhesive layer 27 is provided inside of the insulation tube 26. According to this embodiment, fitting force between the display fluorescent lamp 1, the cylindrical convex portion 25 and the insulation tube 26 can be increased. Further, if a heat-shrinkable tube is used as the insulation tube 26, it is possible to raise the fitting force after heat shrinkage occurs.

Figure 34:
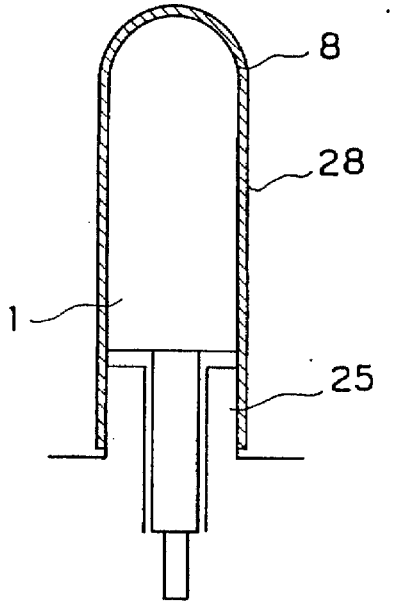
FIG. 34 is a sectional view showing the display device lamp according to still another embodiment of the present invention.

FIG. 34 is a sectional view of the display device according to still another embodiment of the present invention. According to the display device of this embodiment, cylindrical convex portions 25 as shown in FIG. 31 are disposed on portions on the base member 22 of the display device 21, corresponding to the display fluorescent lamps 1, and the convex portions 25 and the light emitting portions 8 of the display fluorescent lamps 1 are covered with common insulation caps 28.

According to this embodiment, the display fluorescent lamps 1 can be water-proofed, and by forming the insulation caps 28 with a material having wavelength selecting transmittance, the necessity of preparing the filter caps as a different component is eliminated. Further, this embodiment has such an advantage that the water proof is improved by forming the insulation caps 28 with silicone rubber.

The insulation caps 28 may be formed with a neutral density filter having a constant transmittance in the entire range of visible rays. Further, the insulation caps 28 may be formed with a color filter having a transmittance characteristic corresponding to the wavelength of visible rays generated by the fluorescent substance. As a result, it is possible to reduce luminance at a time when the lamp is not lighting induced by reflection on the fluorescent substance.

Figure 35:
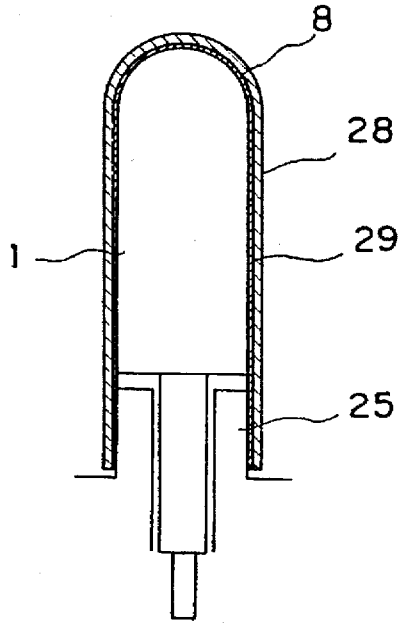
FIG. 35 is a sectional view showing the display device according to still another embodiment of the present invention.

FIG. 35 is a sectional view of the major parts of the display device according to still another embodiment of the present invention. In the display device of this embodiment, adhesive layer 29 is provided inside of the insulation cap 28. According to this embodiment, it is possible to raise the fitting force between the display fluorescent lamp 1, the cylindrical convex portion 25 and the insulation cap 28.

Figure 36:
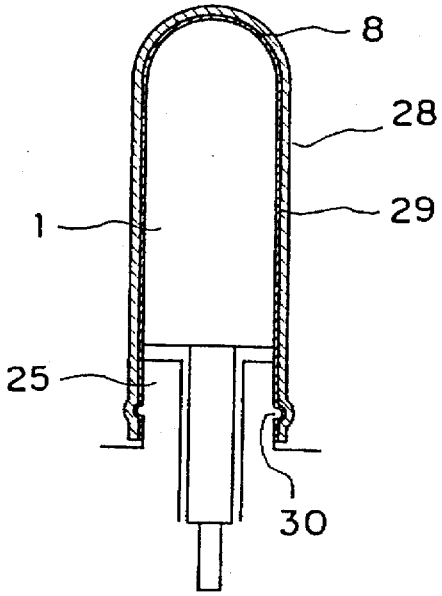
FIG. 36 is a sectional view showing the display device according to still another embodiment of the present invention.

FIG. 36 is a sectional view of the major parts of the display device according to still another embodiment of the present invention. In the display device of this embodiment, protrusions 30 are provided on the circumference of the cylindrical convex portion 25 disposed on the base member 22 of the display device 21. When the insulation cap 28 is fit to the display fluorescent lamp 1, the bottom portion of the insulation cap 28 engages with the cylindrical convex portion 25 firmly, thereby preventing the insulation cap from loosing from the cylindrical convex portion 25. Although the case of the insulation cap 28 is explained here, if the protrusion 30 is provided on the insulation tube 26 as shown in FIGS. 30, 32, and 33 also, the same effect can be gained.

Figure 37:
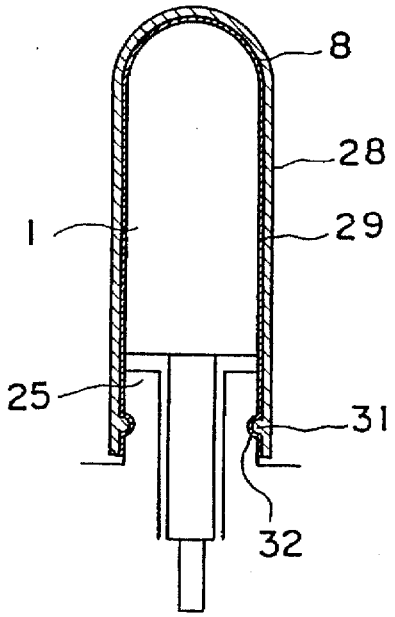
FIG. 37 is a sectional view showing the display device according to still another embodiment of the present invention.

FIG. 37 is a sectional view of the major parts of the display device according to still another embodiment of the present invention. According to the display device of this embodiment, protrusion 31 is provided on the inside face of the portion covering the cylindrical convex portion 25 of the insulation cap 28 and concave portion 32 is provided on the circumference of the cylindrical convex portion 25 corresponding to the protrusion 31.

This embodiment has such an advantage that it is possible to prevent the insulation cap 28 from loosening from the cylindrical convex portion 25 by engagement between the protrusion 31 and the concave portion 32. Although the case of the insulation cap 28 is explained here, in the cases of the insulation caps 26 as shown in FIGS. 30, 32 and 33 also, the same effect can be obtained by providing with the protrusion 31 and the concave portion 32.

Figure 38:
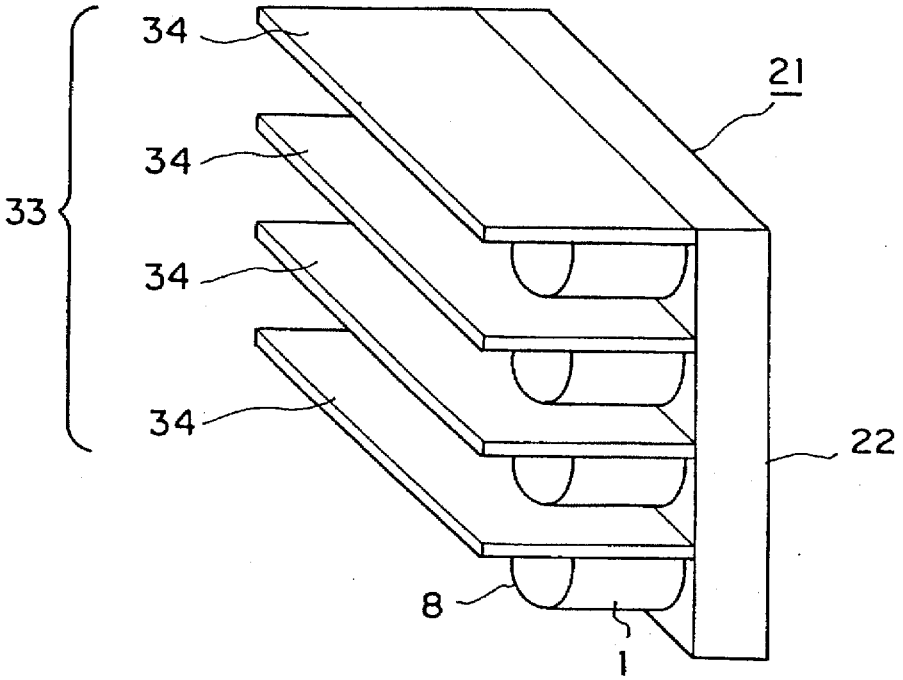
FIG. 38 is a perspective view showing the display device according to still another embodiment of the present invention.
Figure 39:
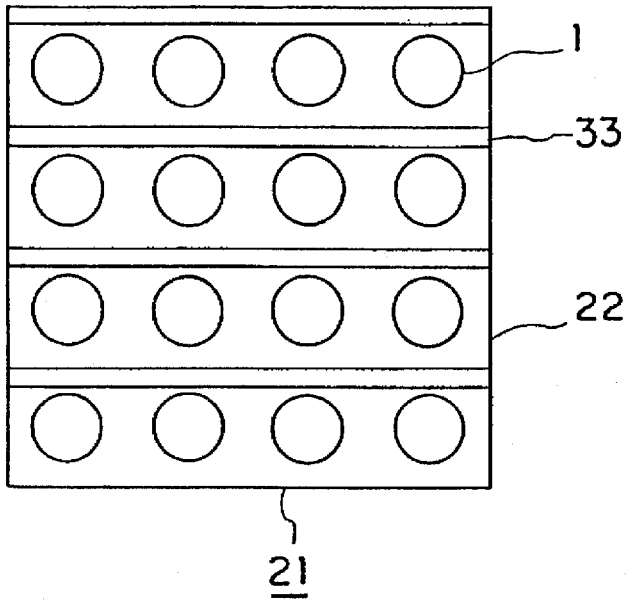
FIG. 39 is a front view showing the light shielding portion shown in FIG. 38.
Figure 40:
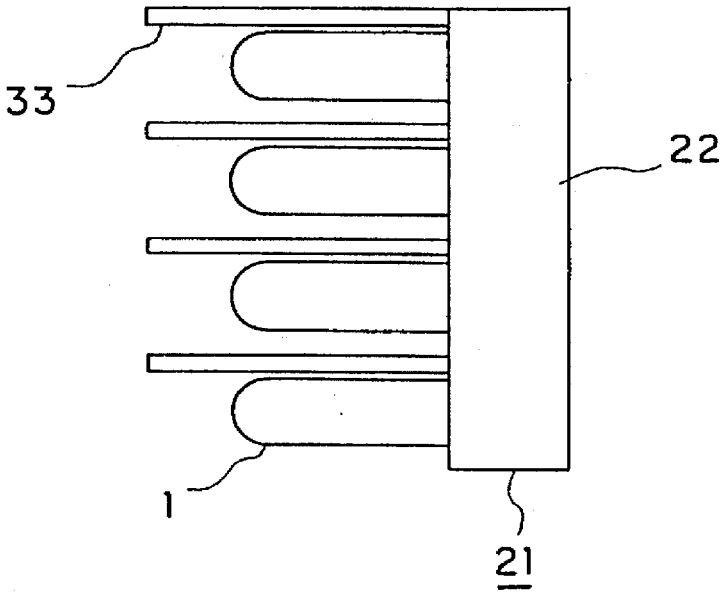
FIG. 40 is a side view showing the light shielding portion shown in FIG. 38.

FIGS. 38, 39 and 40 are a perspective view, a front view and a side view of the display device according to a further embodiment of the present invention. In the display device of this embodiment, light shielding portion 33 is provided to protect the light emitting portion 8 of the display fluorescent lamp 1 from direct external light such as sun light. The light shielding portion 33 comprises light shielding plates 34 which are disposed between rows of the display fluorescent lamps disposed laterally, in order to protect the display fluorescent lamps from direct sun light coming from top or obliquely top. As a result, it is possible to hinder reflection from the fluorescent substance of the display fluorescent lamp 1 thereby reducing luminance at a time when the lamp is not lighting and then realizing high contrast in displayed images.

Although, in the embodiment 18 shown in FIG. 25 through the embodiment 27 shown in FIG. 38, an example in which a single display device is constructed with 16 (4×4) display fluorescent lamps is picked up, the number of the display fluorescent lamps which constitutes a single display device is not restricted to this example.

As a conclusion of the above description, the present invention has the advantages which will be described below.

Because the length in the axial direction, of the small-diameter portion of the cylindrical container is set so as to be longer than an insulation distance required against a voltage to be applied between the internal electrode and the external electrode, even if the diameter of the glass valve is small, it is possible to ensure a sufficient insulation distance between the internal electrode and the external electrode.

According to a preferred aspect of the present invention, because the fluorescent substance layer is disposed to extend up to a point between the small-diameter portion and the large-diameter portion of the cylindrical container, uniform fluorescent substance layer can be formed.

According to another preferred aspect of the present invention, because the external electrode is formed so as to be shorter than the length of the large-diameter portion in the axial direction, of the cylindrical container, it is possible to reduce power consumption.

According to still another preferred aspect of the present invention, because the external electrode is formed in the vicinity of the lower end which is opposite the light emitting portion on the large-diameter portion of the cylindrical container, it is possible to obtain high luminance.

According to a further preferred aspect of the present invention, the creepage distance between the internal electrode and the external electrode can be ensured so as to be large without enlarging the fluorescent lamp.

According to a still further preferred aspect of the present invention, because the external electrode is formed with conductive paste printed on the outside face of the cylindrical container, it is possible to form the external electrode continuously with a uniform thickness.

According to a yet still further preferred aspect of the present invention, because the external electrode is formed so as to extend up to the outside face of the small-diameter portion of the cylindrical container, it is possible to include the space in which the lead wire is connected with the external electrode, within the extended cylindrical portion of the cylindrical container.

According to a yet still further preferred aspect of the present invention, because insulating film is formed on the outside face of portions other than the drive signal supplying portion of the external electrode, it is possible to prevent short circuit between the adjacent external electrodes.

According to a yet still further preferred aspect of the present invention, because the boundary portion between the large-diameter portion and the small-diameter portion of the cylindrical container is formed in a circular or slope shape, printing of the external electrode on the cylindrical container can be facilitated.

According to a yet still further preferred aspect of the present invention, because the external electrode is formed with a cylindrical conductive material and this external electrode is fit to the outside face of the cylindrical container, it is possible to construct the external electrode by only fitting the preliminarily formed cylindrical conductive material to the cylindrical container without complicated processes such as printing.

According to a yet still further preferred aspect of the present invention, because a filter cap having wavelength selecting transmittance is provided on the outside face of the light emitting portion, it is possible to reduce luminance at a time when the lamp is not lighting due to reflection on the fluorescent substance.

According to a yet still further preferred aspect of the present invention, because the filter cap is formed so as to be a neutral density filter, it is possible to secure a constant transmittance in the entire range of visible rays to prevent luminance at a time when the lamp is not lighting due to reflection on the fluorescent substance.

According to a yet still further aspect of the present invention, because the filter cap is formed with a color filter, it is possible to prevent luminance at a time when the lamp is not lighting due to reflection on the fluorescent substance layer using a transmittance characteristic corresponding to the wavelength of visible rays.

According to a yet still further aspect of the present invention, because the filter cap is formed with a silicone rubber, the durability of the filter cap can be improved.

According to a yet still further aspect of the present invention, because the light emitting portion is formed in a flat shape, it is possible to increase the light emitting area.

According to a yet still further aspect of the present invention, because the flat shaped light emitting portion is formed with a different material from the cylindrical portion of the cylindrical container and the cylindrical portion is formed of a dielectric having a higher softening point than the dielectric constituting the cylindrical portion, it is possible to form the cylindrical container easily.

According to a yet still further aspect of the present invention, because the dielectric constituting the flat shaped light emitting portion is formed of soda glass and the dielectric constituting the cylindrical portion is formed of lead glass, it is possible to facilitate fusion between the light emitting portion and the cylindrical portion.

According to a yet still further aspect of the present invention, because the dielectric constituting the flat shaped light emitting portion is formed so as to have a wavelength selecting transmittance, it is possible to reduce luminance at a time when the lamp is not lighting due to reflection on the fluorescent substance layer when the flat shaped light emitting portion is used also.

According to a yet still further aspect of the present invention, because the dielectric constituting the flat shaped light emitting portion is formed as a neutral density filter, it is possible to reduce luminance at a time when the lamp is not lighting by providing a constant transmittance in the entire range of visible rays even if the flat shaped light emitting portion is used.

According to a yet still further aspect of the present invention, because the dielectric constituting the flat shaped light emitting portion is formed as a color filter, it is possible to reduce luminance at a time when the lamp is not lighting by using transmittance characteristic corresponding to the wavelength of visible rays even if the flat shaped light emitting portion is used.

According to a yet still further aspect of the present invention, because the outside face of the flat shaped light emitting portion is provided with a plurality of fine semispherical protrusions, it is possible to reduce luminance at a time when the lamp is not lighting by hindering reflection of external light on the flat shaped light emitting portion by means of the fine semispherical protrusions.

According to a yet still further aspect of the present invention, because the outside face of the flat shaped light emitting portion is provided with a plurality of semicylindrical protrusions which are disposed coaxially, it is possible to reduce luminance at a time when the lamp is not lighting by hindering reflection of external light on the flat shaped light emitting portion by means of the semicylindrical protrusions.

According to a yet still further aspect of the present invention, because the outside face of the small-diameter portion of the cylindrical container is provided with a second external electrode, it is possible to control discharge stably.

According to a yet still further aspect of the present invention, because the second external electrode is disposed at a position on the small-diameter portion of the cylindrical container, which does not overlap the fluorescent substance layer extended up to the joint with the large-diameter portion, it is possible to suppress light emission of the fluorescent substance due to discharge by the second external electrode.

According to a yet still further aspect of the present invention, because a portion of the internal electrode corresponding to the second external electrode is coated with dielectric, it is possible to suppress power consumption due to discharge by the second external electrode.

According to a yet still further aspect of the present invention, because a plurality of small-diameter display fluorescent lamps are arranged in a flat shape to provide a display device, it is possible to obtain high resolution displayed images by arranging the display fluorescent lamps in high density.

According to a yet still further aspect of the present invention, because three types of the display fluorescent lamps, red emission lamps, green emission lamps and blue emission lamps are disposed, it is possible to display color images using red, green, and blue emission lights.

According to a yet still further aspect of the present invention, because the external electrodes are formed so that the length thereof differs on the red emission lamp, the green emission lamp and the blue emission lamp, it is possible to control the brightness of the red emission lamps, the green emission lamps and the blue emission lamps easily.

According to a yet still further aspect of the present invention, because the display fluorescent lamps are disposed in the form of matrix, so that the external electrodes or the internal electrodes of the display fluorescent lamps on the same raw, and the internal electrodes or the external electrodes of the display fluorescent lamps on the same raw are connected with each other with respective coupling members, it is possible to selectively turn ON a plurality of the display fluorescent lamps with few signal lines.

According to a yet still further aspect of the present invention, because convex portions are disposed at portions corresponding to the display fluorescent lamps and the convex portions and portions excluding the light emitting portion of the display fluorescent lamps are covered with a common insulation tube, it is possible to prevent short circuit between the external electrodes of the adjacent display fluorescent lamps with the insulation tubes.

According to a yet still further aspect of the present invention, because adhesive layer is formed between the display fluorescent lamp and the insulation tube, it is possible to secure the insulation tube on the display fluorescent lamp.

According to a yet still further aspect of the present invention, because the insulation tube is constructed in the form of a heat-shrinkable tube, it is possible to facilitate mounting or fastening of the insulation tube to the display fluorescent lamp using the heat shrinkage characteristic of the tube.

According to a yet still further aspect of the present invention, because a cylindrical convex portion on which the display fluorescent lamp is to be mounted is disposed on a portion corresponding to the display fluorescent lamp, and the convex portion and the light emitting portion of the display fluorescent lamp are constructed so as to be covered with a common insulation cap, it is possible to prevent short circuit between respective external electrodes and keep the respective display fluorescent lamps water-proof by putting the insulation caps on the respective display fluorescent lamps which are disposed adjacently.

According to a yet still further aspect of the present invention, because the insulation cap is formed with a wavelength selecting transmittance, it is possible to reduce luminance in the light emitting portion at a time when the lamp is not lighting even if the insulation cap is used.

According to a yet still further aspect of the present invention, because the insulation cap is formed as a neutral density filter, it is possible to provide a constant transmittance in the entire range of visible rays to reduce luminance at a time when the lamp is not lighting even if the insulation cap is used.

According to a yet still further aspect of the present invention, because the insulation cap is formed as a color filter, it is possible to reduce luminance at a time when the lamp is not lighting using a transmittance corresponding to the wavelength of visible rays even if the insulation cap is used.

According to a yet still further aspect of the present invention, because the insulation cap is formed of silicone rubber, it is possible to improve the durability of the insulation cap.

According to a yet still further aspect of the present invention, because adhesive layer is formed between the insulation cap and the display fluorescent lamp, it is possible to fix the insulation cap unremovably and securely to the display fluorescent lamp.

According to a yet still further aspect of the present invention, because protrusions are formed on the outside face of the cylindrical convex portion, it is possible to fix the insulation cap easily to the convex portion.

According to a yet still further aspect of the present invention, because the inside face of portions covering the outside face of the cylindrical convex portion, of the insulation tube or the insulation cap is provided with the protrusions and the outside face of the cylindrical convex portion corresponding to the protrusions is provided with concave portions engaging with the protrusions, it is possible to further secure engagement of the insulation tube or the insulation cap with the convex portion.

According to a yet still further aspect of the present invention, because the light shielding portion is disposed to shield external light to the light emitting portion of the display fluorescent lamp, it is possible to hinder the entering of external lights such as sun light in order to reduce luminance at a time when the lamp is not lighting due to reflection on the fluorescent substance.

It is to be understood that changes and variations may be made without departing from the spirit or scope of the present invention. The present invention is not restricted to particular aspects thereof except those specified in the attached claims.

What is claimed is:

1. A display fluorescent lamp comprising;

a dielectric cylindrical container having a large-diameter portion in which rare gas is sealed and a small-diameter portion which is almost coaxially connected with said large-diameter portion at one end of said large-diameter portion, the outside diameter thereof being smaller than that of said large-diameter portion;

a light emitting portion which is formed at another end of said large-diameter portion and has light permeability;

an internal electrode which is inserted into said cylindrical container from the other end of said small-diameter portion which is not connected with said large-diameter portion, a fluorescent substance layer formed on the inside face excluding that in which said light emitting portion is formed, of the large-diameter portion of said cylindrical container; and an external electrode formed on the outside face of said large-diameter portion excluding a portion in which said light emitting portion of said cylindrical container is formed, wherein the length in the axial direction, of said small-diameter portion being set so as to be longer than an insulation distance required against a voltage to be applied between said internal electrode and said external electrode.

2. A display fluorescent lamp according to claim 1 wherein said fluorescent substance layer is disposed so as to extend up to the small-diameter portion of said cylindrical container.

3. A display fluorescent lamp according to claim 1 wherein said external electrode is shorter than the length of the large-diameter portion of said cylindrical container in the axial direction.

4. A display fluorescent lamp according to claim 3 wherein said external electrode is formed in the vicinity of an end which is opposite the end in which said light emitting portion of said cylindrical container is disposed.

5. A display fluorescent lamp according to claim 1 wherein the outside face of said small-diameter portion has a fold or wrinkle for increasing the creepage distance between said internal electrode and said external electrode.

6. A display fluorescent lamp according to claim 1 wherein said external electrode is formed by coating or printing conductive paste on the outside face of said cylindrical container.

7. A display fluorescent lamp according to claim 1 wherein said external electrode is disposed so as to extend up to the outside face of the small-diameter portion of said cylindrical container.

8. A display fluorescent lamp according to claim 1 wherein the outside face of said external electrode has an insulation film.

9. A display fluorescent lamp according to claim 1 wherein a boundary portion between the large-diameter portion and the small-diameter portion of said cylindrical container has a portion in which the outside diameter changes in a circular or sloped form.

10. A display fluorescent lamp according to claim 1 wherein said external electrode comprises a cylindrical or C-shaped conductive material engaged with the outside of said cylindrical container.

11. A display fluorescent lamp according to claim 1 wherein a filter cap having wavelength selecting transmittance is provided on the outside face of the light emitting portion.

12. A display fluorescent lamp according to claim 1 wherein said light emitting portion has partially a flat portion.

13. A display fluorescent lamp according to claim 12 wherein said light emitting portion is formed of dielectric having a softening point higher than a softening point of dielectric constituting the cylindrical portion of the cylindrical container.

14. A display fluorescent lamp according to claim 1 wherein the outside face of the small-diameter portion of said cylindrical container is provided with a second external electrode.

15. A display fluorescent lamp according to claim 14 wherein a portion of said internal electrode corresponding to said second external electrode is coated with dielectric.

16. A display device including a plurality of display fluorescent lamps each of which comprises;

a dielectric cylindrical container having a large-diameter portion in which rare gas is sealed and a small-diameter portion which is almost coaxially connected with said large-diameter portion at one end of said large-diameter portion, the outside diameter thereof being smaller than that of said large-diameter portion;

a light emitting portion which is formed at another end of said large-diameter portion and has permeability;

an internal electrode which is inserted into said cylindrical container from the other end of said small-diameter portion which is not connected with said large-diameter portion;

a fluorescent substance layer formed on the inside face excluding that in which said light emitting portion is formed, of said large-diameter portion of said cylindrical container; and an external electrode formed on the outside face of said large-diameter portion excluding a portion in which said light emitting portion of said cylindrical container is formed, said plurality of display fluorescent lamps being disposed adjacently in a linear or plane shape, wherein the length of said small-diameter portion in the axial direction being set so as to be larger than the insulation distance required for a voltage to be applied between said internal electrode and said external electrode.

17. A display device according to claim 16 wherein three or more types of the display fluorescent lamps each including red emission lamps, green emission lamps or blue emission lamps are disposed.

18. A display device according to claim 16 wherein said plurality of display fluorescent lamps are disposed in the form of matrix, so that the external electrodes or the internal electrodes of said display fluorescent lamps on each column, and the internal electrodes or the external electrodes of said display fluorescent lamps on each row are connected with each other.

19. A display device according to claim 16 wherein a plurality of cylindrical convex portions are disposed on a flat plane or a curved plane in which said plurality of display fluorescent lamps are arranged, the small-diameter portion of said display fluorescent lamp being inserted into a center hole of said respective convex portions, said convex portion and the large-diameter portion of said display fluorescent lamp being covered with a common insulation tube.

20. A display device according to claim 16 wherein light shielding portions are disposed to shield external light to the light emitting portion of said display fluorescent lamps.

* * * * *